US010981378B2

(12) United States Patent
Ishikawa

(10) Patent No.: US 10,981,378 B2
(45) Date of Patent: Apr. 20, 2021

(54) IMAGE-FORMING APPARATUS, NON-TRANSITORY COMPUTER-READABLE MEDIUM STORING COMPUTER-READABLE INSTRUCTIONS, AND METHOD FOR DISCHARGING DEPOSITS ON A FILTER OF AN IMAGE-FORMING APPARATUS

(71) Applicant: BROTHER KOGYO KABUSHIKI KAISHA, Nagoya (JP)

(72) Inventor: Akihiro Ishikawa, Nagoya (JP)

(73) Assignee: BROTHER KOGYO KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 16/752,218

(22) Filed: Jan. 24, 2020

(65) Prior Publication Data

US 2020/0247112 A1 Aug. 6, 2020

(30) Foreign Application Priority Data

Jan. 31, 2019 (JP) ..... JP2019-015809

(51) Int. Cl.
*B41J 2/045* (2006.01)
*B41J 2/175* (2006.01)
*B41J 29/38* (2006.01)

(52) U.S. Cl.
CPC ..... *B41J 2/04501* (2013.01); *B41J 2/17503* (2013.01); *B41J 29/38* (2013.01)

(58) Field of Classification Search
CPC combination set(s) only.
See application file for complete search history.

(56) References Cited

U.S. PATENT DOCUMENTS

2010/0321424 A1 12/2010 Tamaki
2011/0304678 A1 12/2011 Yamamoto
2015/0191016 A1* 7/2015 Matsumoto ..... B41J 2/16538 347/29
2017/0210124 A1 7/2017 Ng et al.
2017/0210126 A1 7/2017 Kato
2017/0253038 A1* 9/2017 Takanashi ..... B41J 2/175
2018/0056656 A1* 3/2018 Murayama ..... B41J 2/175

FOREIGN PATENT DOCUMENTS

JP 2006-088492 A 4/2006
JP 2011-000834 A 1/2011
JP 5516106 B2 6/2014
JP 2017-132096 A 8/2017

* cited by examiner

*Primary Examiner* — Kristal Feggins
(74) *Attorney, Agent, or Firm* — K&L Gates LLP

(57) ABSTRACT

The disclosure provides an image-forming apparatus which can remove deposits on the filter. If there is input via operation buttons indicating that ink supply paths are closed off, a CPU drives a pump while a nozzle cleaning valve and an exhaust waste fluid valve are open, and an atmospheric valve and a nozzle waste fluid valve are closed. The pressure in an exhaust waste fluid flow path and inside an exhaust cap becomes negative, such that cleaning fluid flows from a cleaning fluid bottle into a cleaning fluid flow path, a nozzle cleaning valve, a cleaning fluid flow path, a nozzle cap, a filter, an ink supply flow path, and an exhaust flow path. Therefore, deposits adhered to the filter from the ink passing through the filter separate from the filter due to the cleaning fluid passing through the filter, and these deposits flow into the exhaust flow path.

12 Claims, 23 Drawing Sheets

IMAGE-FORMING APPARATUS, NON-TRANSITORY COMPUTER-READABLE MEDIUM STORING COMPUTER-READABLE INSTRUCTIONS, AND METHOD FOR DISCHARGING DEPOSITS ON A FILTER OF AN IMAGE-FORMING APPARATUS

CROSS-REFERENCE TO RELATED APPLICATION

This application claims priority to Japanese Patent Application No. 2019-15809 filed Jan. 31, 2019. The contents of the foregoing application are hereby incorporated herein by reference.

BACKGROUND

The present disclosure relates to an image-forming apparatus, a non-transitory computer-readable medium storing computer-readable instructions, and a method for discharging deposits on a filter of an image-forming apparatus.

An image-forming apparatus provided with a filter in a flow path for supplying ink from an ink cartridge to a head is known. The filter is made of non-woven cloth, for example, and removes settled pigment components, gas, and foreign matter mixed in with white ink passing through the flow path.

SUMMARY

However, in this related image-forming apparatus, the ink that passes through the filter flows in one direction, so sediment trapped on the filter is unable to be removed, which was problematic.

Embodiments of the broad principles derived herein provide an image-forming apparatus capable of removing sediment on a filter, a non-transitory computer-readable medium storing computer-readable instructions, and a filter of an image-forming apparatus.

A first aspect of the present disclosure relates to an image-forming apparatus including a first fluid supply path configured to supply a first fluid from one side of a discharge outlet of a head; a first opening/closing portion configured to open and close the first fluid supply path; a filter disposed in the first fluid supply path upstream of the discharge outlet of the head and downstream of the first opening/closing portion, and configured to filter the first fluid to be supplied to the discharge outlet of the head; a branch path communicated with the first fluid supply path upstream of the filter and downstream of the first opening/closing portion; a second fluid supply path configured to supply a second fluid from the other side that is the side opposite the one side of the discharge outlet; a first fluid supply portion configured to supply the first fluid to the first fluid supply path while the first fluid supply path is opened by the first opening/closing portion; and a second fluid supply portion configured to supply the second fluid to the second fluid supply path while the first fluid supply path is closed by the first opening/closing portion, in which the second fluid supplied to the second fluid supply path by the second fluid supply portion while the first fluid supply path is closed off by the first opening/closing portion flows into the branch path after passing through the second fluid supply path, the discharge outlet, and the filter in this order.

In this case, deposits adhered to the filter from the first fluid passing through the filter separate from the filter due to the second fluid passing through the filter. The separated deposits then flow into a branch flow path. These deposits are separated from the first fluid supply path upstream of the first opening/closing portion. As a result, it is less likely that these deposits will become entrapped in the first fluid supply path upstream of the first opening/closing portion, and adhere to the filter again, such that ink will no longer be able to sufficiently pass through the filter. Therefore, printing is less likely to become poor.

A second aspect of the present disclosure relates to a non-transitory computer-readable medium storing computer-readable instructions that, when executed by a processor of an image-forming apparatus including a first fluid supply path configured to supply a first fluid from one side of a discharge outlet of a head; a first opening/closing portion configured to open and close the first fluid supply path; a filter disposed in the first fluid supply path upstream of the discharge outlet of the head and downstream of the first opening/closing portion, and configured to filter the first fluid to be supplied to the discharge outlet of the head; a branch path communicated with the first fluid supply path upstream of the filter and downstream of the first opening/closing portion; a second fluid supply path configured to supply a second fluid from the other side that is the side opposite the one side of the discharge outlet; a first fluid supply portion configured to supply the first fluid to the first fluid supply path while the first fluid supply path is opened by the first opening/closing portion; a second fluid supply portion configured to supply the second fluid to the second fluid supply path while the first fluid supply path is closed by the first opening/closing portion; a branch path opening/closing portion configured to open and close the branch path downstream of a connecting portion where the branch path is connected to the first fluid supply path; a nozzle surface provided on the head and which has the discharge outlet; an exhaust port provided on the side of the branch path that is opposite the side communicated with the first fluid supply path; a nozzle cap configured to contact the nozzle surface; an exhaust cap configured to cover the exhaust port; an inflow port provided in the nozzle cap and through which the second fluid flows in; an outflow port provided in the nozzle cap and through which the second fluid flows out; a waste fluid flow path connected to the outflow port; a waste fluid flow path opening/closing portion configured to open and close the waste fluid flow path; an exhaust cap exhaust port provided in the exhaust cap; a pump provided downstream of the waste fluid flow path opening/closing portion; an exhaust flow path connected to the exhaust cap exhaust port; a second fluid supply path opening/closing portion configured to open and close the second fluid supply path; a nozzle cap drive mechanism configured to move the nozzle cap up and down toward the nozzle surface; an exhaust cap drive mechanism configured to move the exhaust cap up and down toward the nozzle surface; and a processor, in which the branch path opening/closing portion opens and closes the exhaust flow path, one end portion of the second fluid supply path is connected to the inflow port, the second fluid supply path opening/closing portion is provided between the second fluid supply path and a second fluid storage portion that stores the second fluid, and the downstream side of the branch path opening/closing portion is connected to the pump, cause the processor of the image-forming apparatus to execute capping processing to cause the nozzle cap to come into contact with the nozzle surface by controlling the nozzle cap drive mechanism, and cover the exhaust port with the exhaust cap by controlling the exhaust cap drive mechanism, first valve opening processing to open the second fluid supply path opening/closing portion and the waste fluid flow path opening/closing portion, second fluid injecting processing to fill the nozzle cap with the second fluid by driving the pump, first valve closing processing to close the second fluid supply path opening/closing portion and the waste fluid flow path opening/closing portion, second valve opening processing to open the second fluid supply path opening/closing portion and the branch path opening/closing portion, and filter cleaning processing to cause the second fluid in the nozzle cap to flow through the discharge outlet and the filter in this order, and then flow into the branch path, by driving the pump.

In this case, deposits adhered to the filter from the first fluid passing through the filter separate from the filter due to the second fluid passing through the filter. The separated deposit then flows into the branch flow path. These deposits are separated from the first fluid supply path upstream of the first opening/closing portion. As a result, it is less likely that these deposits will become entrapped in the first fluid supply path upstream of the first opening/closing portion, and adhere to the filter again, such that ink will no longer be able to sufficiently pass through the filter. Therefore, printing is less likely to become poor.

A third aspect of the present disclosure relates to a method for discharging deposits on a filter of an image-forming apparatus including a first fluid supply path configured to supply a first fluid from one side of a discharge outlet of a head; a first opening/closing portion configured to open and close the first fluid supply path; a filter disposed in the first fluid supply path upstream of the discharge outlet of the head and downstream of the first opening/closing portion, and configured to filter the first fluid to be supplied to the discharge outlet of the head; a branch path communicated with the first fluid supply path upstream of the filter and downstream of the first opening/closing portion; a second fluid supply path configured to supply a second fluid from the other side that is the side opposite the one side of the discharge outlet; a first fluid supply portion configured to supply the first fluid to the first fluid supply path while the first fluid supply path is opened by the first opening/closing portion; a second fluid supply portion configured to supply the second fluid to the second fluid supply path while the first fluid supply path is closed by the first opening/closing portion; a branch path opening/closing portion configured to open and close the branch path downstream of a connecting portion where the branch path is connected to the first fluid supply path; a nozzle surface provided on the head and which has the discharge outlet; an exhaust port provided on the side of the branch path that is opposite the side communicated with the first fluid supply path; a nozzle cap configured to contact the nozzle surface; an exhaust cap configured to cover the exhaust port; an inflow port provided in the nozzle cap and through which the second fluid flows in; an outflow port provided in the nozzle cap and through which the second fluid flows out; a waste fluid flow path connected to the outflow port; a waste fluid flow path opening/closing portion configured to open and close the waste fluid flow path; an exhaust cap exhaust port provided in the exhaust cap; a pump provided downstream of the waste fluid flow path opening/closing portion; an exhaust flow path connected to the exhaust cap exhaust port; a second fluid supply path opening/closing portion configured to open and close the second fluid supply path; a nozzle cap drive mechanism configured to move the nozzle cap up and down toward the nozzle surface; an exhaust cap drive mechanism configured to move the exhaust cap up and down toward the nozzle surface; and a processor, in which the branch path opening/closing portion opens and closes the exhaust flow path, one end portion of the second fluid supply path is connected to the inflow port, the second fluid supply path opening/closing portion is provided between the second fluid supply path and a second fluid storage portion that stores the second fluid, and the downstream side of the branch path opening/closing portion is connected to the pump, the method for discharging deposits on the filter of the image-forming apparatus including, in a state in which the first fluid supply path is closed off by the first opening/closing portion, capping processing to cause the nozzle cap to come into contact with the nozzle surface by controlling the nozzle cap drive mechanism, and cover the exhaust port with the exhaust cap by controlling the exhaust cap drive mechanism; first valve opening processing to open the second fluid supply path opening/closing portion and the waste fluid flow path opening/closing portion; second fluid injecting processing to fill the nozzle cap with the second fluid by driving the pump; first valve closing processing to close the second fluid supply path opening/closing portion and the waste fluid flow path opening/closing portion; second valve opening processing to open the second fluid supply path opening/closing portion and the branch path opening/closing portion; and filter cleaning processing to cause the second fluid in the nozzle cap to flow through the discharge outlet and the filter in this order, and then flow into the branch path, by driving the pump.

In this case, deposits adhered to the filter from the first fluid passing through the filter separate from the filter due to the second fluid passing through the filter. The separated deposit then flows into the branch flow path. These deposits are separated from the first fluid supply path upstream of the first opening/closing portion. Thus, it is less likely that these deposits will become entrapped in the first fluid supply path upstream of the first opening/closing portion, and adhere to the filter again, such that ink will no longer be able to sufficiently pass through the filter. Therefore, printing is less likely to become poor.

BRIEF DESCRIPTION OF THE DRAWINGS

Embodiments will be described below in detail with reference to the accompanying drawings in which.

DETAILED DESCRIPTION

Embodiments of the present disclosure will now be described with reference to the drawings. The general configuration of a printer 1 will be described with reference to FIG. 1 and FIG. 2. The upper side, the lower side, the lower left side, the upper right side, the lower right side, and the upper left side of FIG. 1 are the upper side, the lower side, the front side, the rear side, the right side, and the left side, respectively, of the printer 1.

Figure 1:
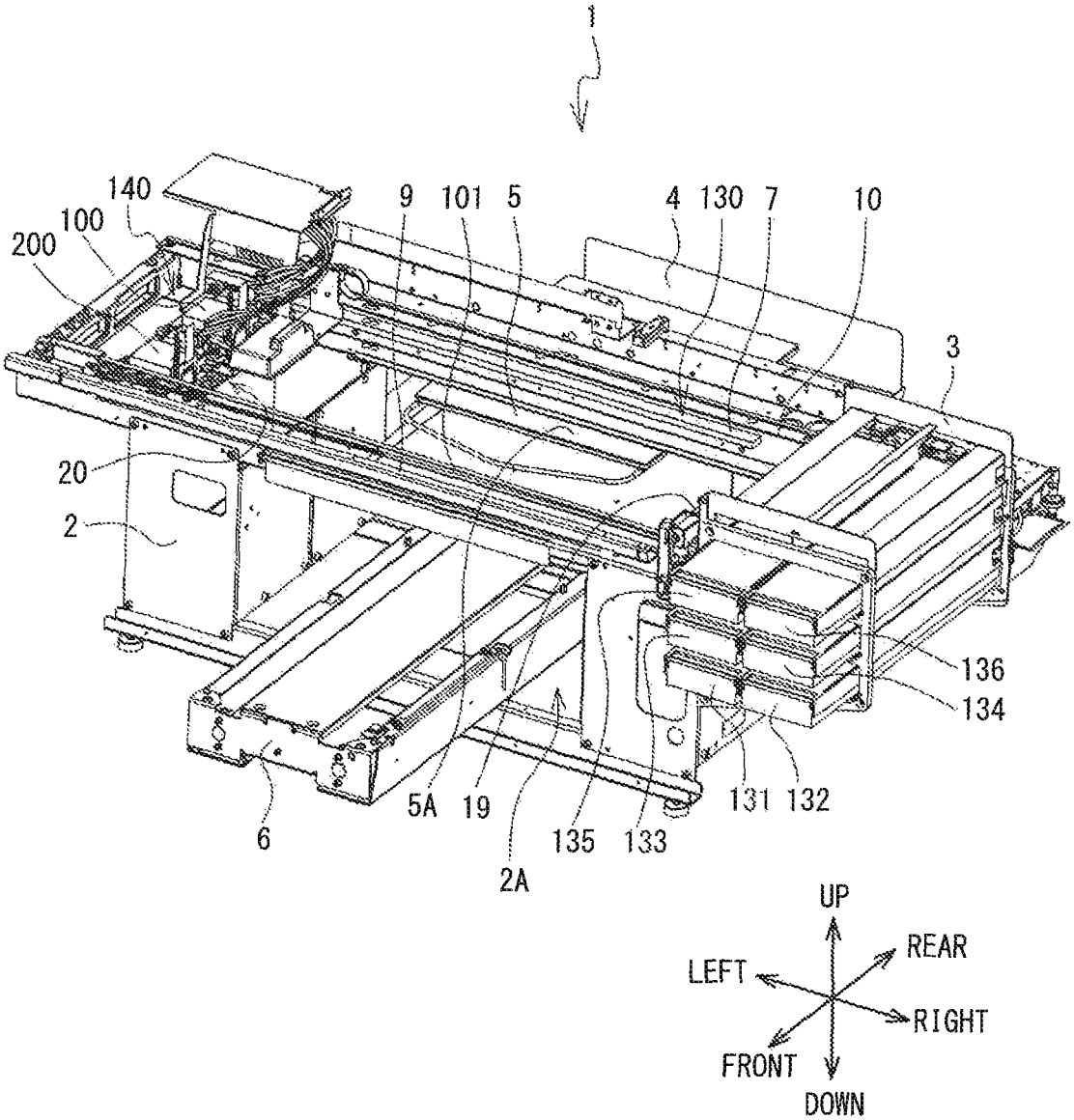
FIG. 1 is a perspective view of a printer.

As shown in FIG. 1, the printer 1 is an inkjet printer that performs printing by ejecting fluid ink onto a print medium (not shown in the drawings). The print medium of the printer 1 is primarily the cloth, such as a T-shirt or the like or paper or the like. The printer 1 prints a color image on the print medium by downwardly ejecting five mutually different types of the ink (white (W), black (K), yellow (Y), cyan (C), and magenta (M)). In the following explanation, of the five types of ink, the white ink will be referred to as white ink, and when the inks of the four colors of black, cyan, yellow, and magenta are collectively referred to, they will be referred to as color ink. Also, when the white ink and the color ink are collectively referred to, or when the ink is not specified, it will simply be referred to as ink. When cloth is the print medium, a method to improve the adhesion of the ink to the cloth by including a synthetic resin component in the ink has conventionally been adopted. White ink includes an emulsion, and includes titanium oxide as a pigment. The titanium oxide is an inorganic pigment with a relatively high specific weight, so the pigment particles tend to settle when used in inkjet ink which has a low viscosity. Therefore, when printing with white ink has not been performed for an extended period of time, printing with white ink must be performed after the white ink has been agitated.

As shown in FIG. 1, the printer 1 includes a housing 2, a platen drive mechanism 6, a mounting portion 3, a guide shaft 9, a rail 7, a carriage 20, head units 100 and 200, a drive belt 101, a drive motor 19, and maintenance portions 141 and 142 (refer to FIG. 3), and the like.

An operation portion (not shown in the drawings) for operating the printer 1 is provided at a position on the right front side of the housing 2. The operation portion includes a display 45 and operation buttons 46 shown in FIG. 10. The operation buttons 46 are operated when a user inputs commands relating to various operations of the printer 1.

The platen drive mechanism 6 is provided with a pair of guide rails (not shown in the drawings), the platen 5, and the tray 4. The pair of guide rails extend in the front-rear direction inside the platen drive mechanism 6, and support the platen 5 and the tray 4 such that the platen 5 and the tray 4 can move in the front-rear direction. The platen drive mechanism 6 moves the platen 5 in the front-rear direction along the pair of guide rails inside the housing 2, using a motor (not shown in the drawings) provided on a rear end portion as the drive source. The platen 5 has a substantially rectangular plate shape in a plan view. The platen 5 holds the print medium formed by the cloth, such as a T-shirt, for example, on a holding surface 5A of an upper portion of the platen 5.

The tray 4 has a rectangular shape and is provided below the platen 5. The tray 4 receives the sleeves and the like of the T-shirt when the user places the cloth on the platen 5.

The mounting portion 3 has a substantially rectangular cuboid shape and an open end at the front end. The mounting portion 3 detachably mounts cartridges 131 to 136 therein. The cartridges 131 and 132 store white ink to be supplied to the head unit 100. The cartridges 133 and 136 each store color ink to be supplied to the head unit 200. Note that a pump (not shown in the drawings) for circulating the white ink is disposed on a rear end portion inside the mounting portion 3. The printer 1 circulates the white ink by this pump before executing printing with the white ink, for example.

The frame body 10 is a frame shape that has a substantially rectangular shape and is disposed on an upper portion of the housing 2. The frame body 10 supports the guide shaft 9 on the front side thereof, and supports the rail 7 on the rear side thereof. The guide shaft 9 extends in the left-right direction inside the frame body 10. The rail 7 is a rod-like member disposed facing the guide shaft 9.

The carriage 20 is supported in a manner so as to be able to be conveyed in the left-right direction along the guide shaft 9. The head units 100 and 200 are lined up in the front-rear direction and mounted to the carriage 20. The head unit 100 is positioned further to the rear than the head unit 200. A head portion 110 capable of ejecting ink toward the print medium is provided on a bottom portion of the head unit 100 (refer to FIG. 4). The bottom portion of the head unit 200 is configured similar to the bottom portion of the head unit 100.

The drive belt 101 is stretched along the left-right direction on the inside the frame body 10. The drive motor 19 is provided on a right front portion inside the frame body 10. The drive motor 19 is coupled to the carriage 20 via the drive belt 101. When the drive motor 19 drives the drive belt 101, the carriage 20 is consequently moved back and forth in the left-right direction. The head units 100 and 200 are moved back and forth in the left-right direction. The head units 100 and 200 eject ink toward the platen 5 that is disposed on the lower side facing the head units 100 and 200. Therefore, printing is performed onto the print medium that is supported by the platen 5.

The area in the movement path of the head units 100 and 200 where printing is to be executed by the head units 100 and 200 will be referred to as the print area 130. The area in the movement path of the head units 100 and 200 other than the print area 130 will be referred to as the non-print area 140. The non-print area 140 includes the area at the left end portion of the printer 1. The print area 130 is located on the right side of the non-print area 140. The platen 5 and the tray 4 are movably provided in the print area 130.

Figure 2:
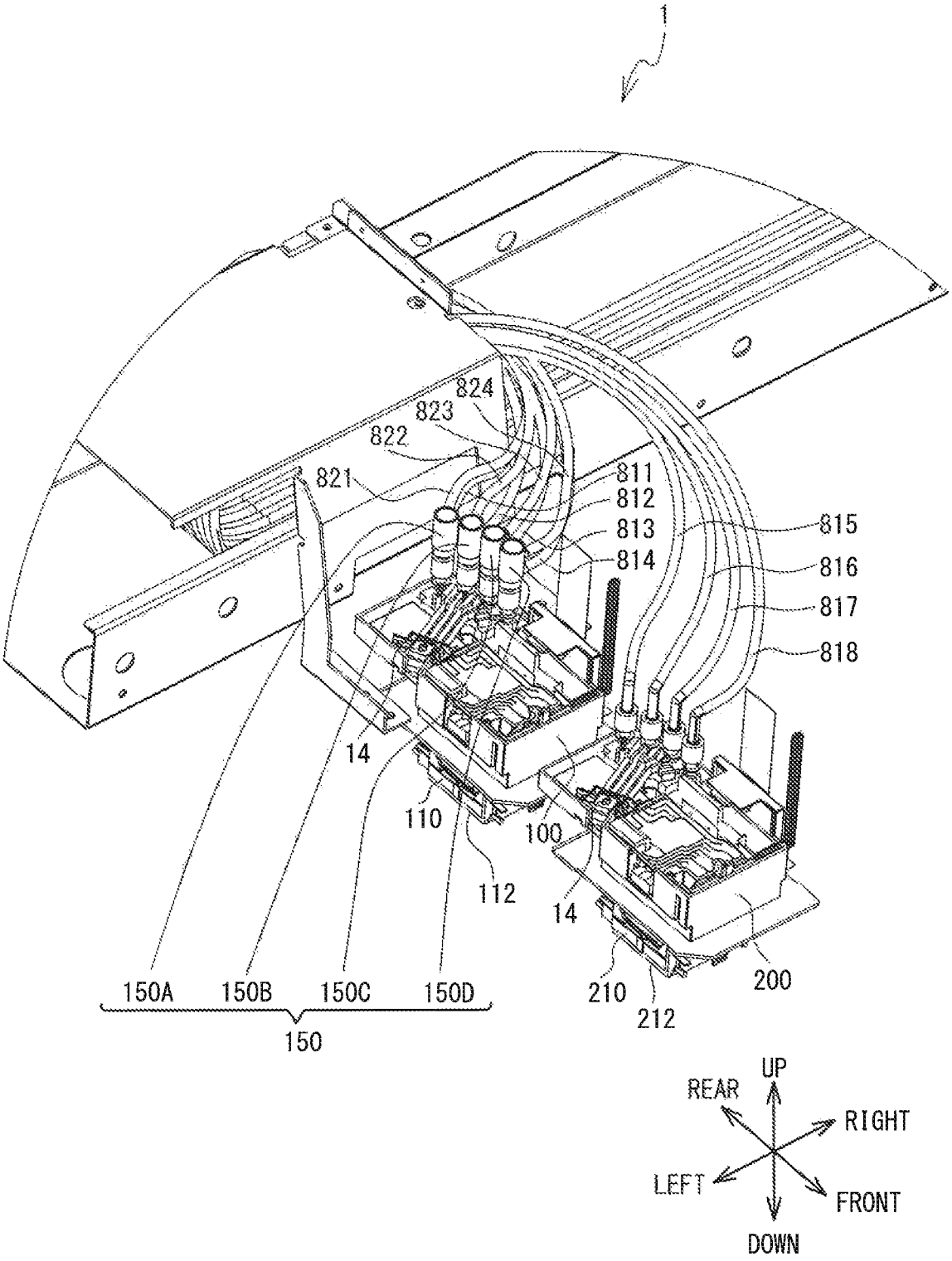
FIG. 2 is an expanded view of the area near a first head unit and a second head unit of the printer.

The detailed configuration of the head unit 100 and the head unit 200 will now be described with reference to FIG. 2. The head unit 100 has, on a lower side portion, the head portion 110 that ejects the white ink supplied from the cartridges 131 and 132. The inside of the head portion 110 is divided into four internal spaces (not shown in the drawings) along the left-right direction, corresponding to ink supply tubes 811, 812, 813, and 814, respectively, which supply the white ink to the head unit 100. The head portion 110 has a flat nozzle surface 112 on which a plurality of nozzles 111 (refer to FIG. 4 and FIG. 5) capable of ejecting white ink are provided. The nozzle surface 112 forms the bottom surface of the head portion 110. The plurality of nozzles 111 are aligned in one row from the front side of the nozzle surface 112 toward the rear along the front-rear direction, and a plurality of such rows are aligned along the left-right direction.

The head unit 200 has, on a lower side portion, a head portion 210 that ejects the color ink supplied from the cartridges 133 to 136. The inside of the head portion 210 is divided into four internal spaces (not shown in the drawings) along the left-right direction, corresponding to ink supply tubes 815, 816, 817, and 818, respectively, which supply the color ink to the head unit 200. The head portion 210 has a flat nozzle surface 212 on which a plurality of nozzles (not shown in the drawings) capable of ejecting color ink are provided. The nozzle surface 212 forms the bottom surface of the head portion 210. Although not shown in the drawings, the plurality of nozzles are aligned in one row from the front side of the nozzle surface 212 toward the rear along the front-rear direction, and a plurality of such rows are aligned along the left-right direction.

The plurality of nozzles correspond to a plurality of ejection channels (not shown in the drawings) provided inside the head portion 110 and the head portion 210. The plurality of ejection channels can eject ink downward from corresponding nozzles by driving a plurality of piezoelectric elements (not shown in the drawings) provided inside the head portion 110 and the head portion 210. That is, the head portion 110 ejects the white ink. The head portion 110 is divided into four parts, similar to the head portion 210, but the white ink is ejected from all of the nozzles. Also, the head portion 210 includes a nozzle group including a plurality of nozzles that eject black ink, a nozzle group including a plurality of nozzles that eject cyan ink, a nozzle group including a plurality of nozzles that eject yellow ink, and a nozzle group including a plurality of nozzles that eject magenta ink.

Check valve units 150A, 150B, 150C, and 150D are provided lined up in the front-rear direction on the right side of the head unit 100. The check valve units 150A to 150D are members that connect flow paths from each of the cartridges 131 and 132 and flow paths to the head unit 100. The check valve units 150A and 150B are connected to the cartridge 131 via the ink supply tubes 811 and 812, and ink circulation tubes 821 and 822 that circulate the white ink, respectively. The check valve units 150C and 150D are connected to the cartridge 132 via the ink supply tubes 813 and 814, and ink circulation tubes 823 and 824 that circulates the white ink, respectively. In the explanation below, when the check valve units 150A to 150D are referred to collectively, or when the check valve unit is not specified, they or it may be referred to as check valve unit 150.

Figure 3:
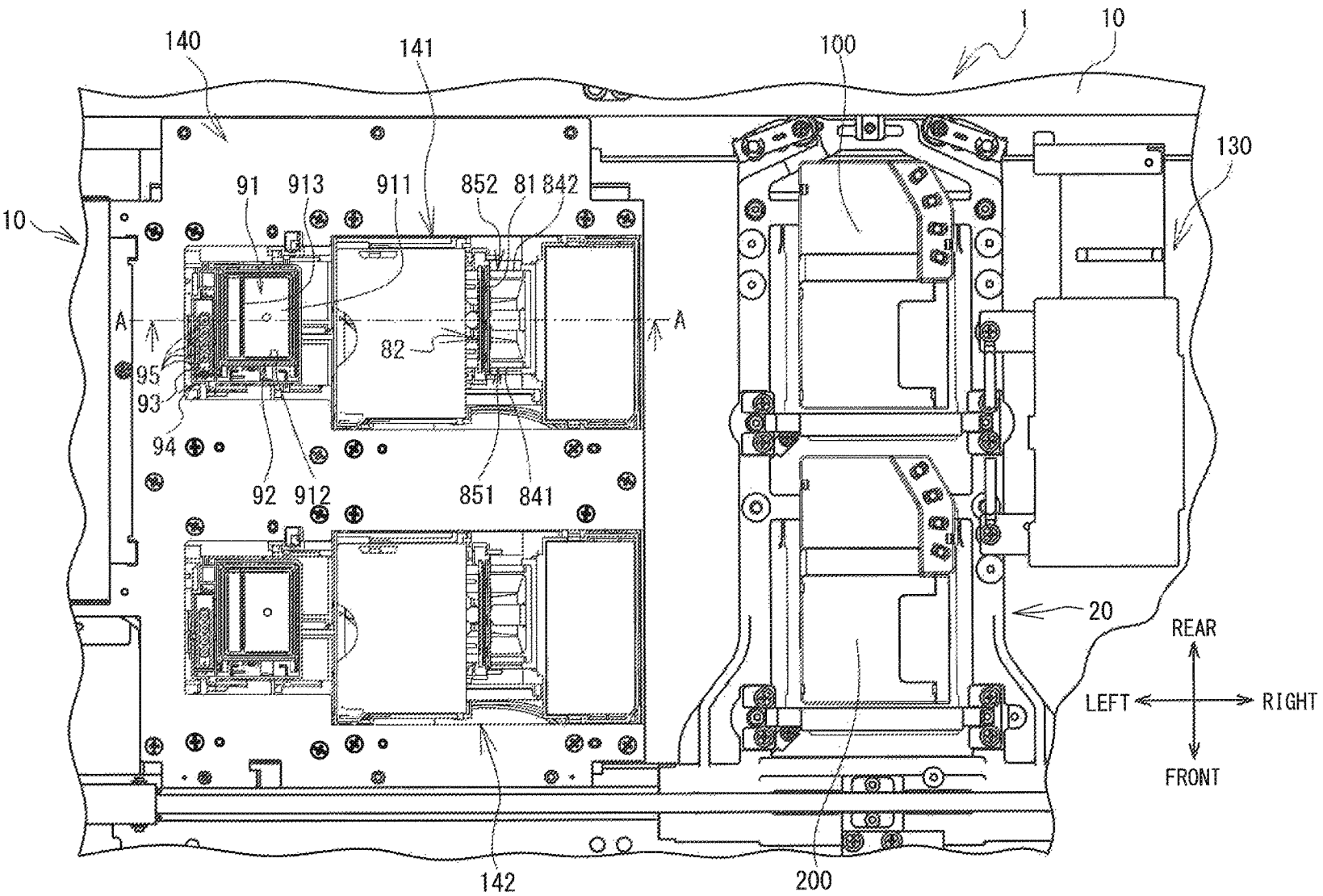
FIG. 3 is a plan view of the printer.

As shown in FIG. 3, the maintenance portions 141 and 142 are provided below the movement paths of the head units 100 and 200 in the non-print area 140, respectively. In the maintenance portions 141 and 142, various maintenance operations such as purging and nozzle surface wiping are executed to restore ink ejection performance of the head units 100 and 200, and ensure print quality of the printer 1. Purging is an operation by which the head units 100 and 200 discharge ink containing foreign matter or air bubbles or the like from the head portion 110 and the like. By executing purging, the printer 1 sucks up ink containing foreign matter and air bubbles and the like from the head portion 110, for example, thus making it possible to reduce the likelihood of poor ejection occurring with the head portion 110. Nozzle surface wiping is an operation by which a wiper 81 that will be described later wipes away excess ink and the like remaining on the surface of the nozzle surface 112 of the head portion 110. By executing nozzle surface wiping, the printer 1 can reduce the likelihood that ink remaining on the nozzle surface 112 will adhere to the nozzle surface 112, for example, which would make it difficult to eject ink from the nozzle surface 112. The maintenance portions 141 and 142 will be described in detail later.

Figure 4:
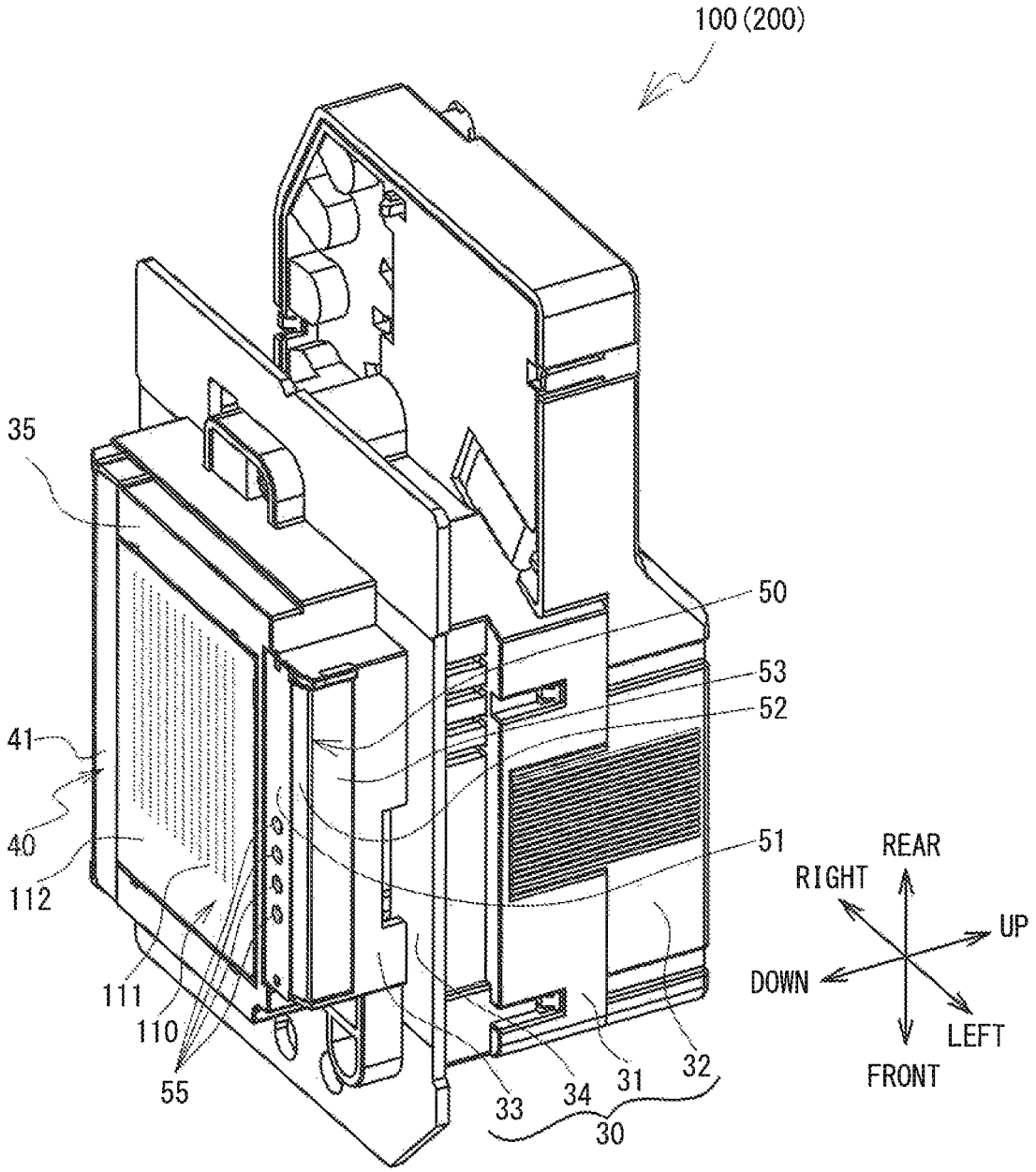
FIG. 4 is a perspective view of the first head unit.

As shown in FIG. 4 to FIG. 7, the head unit 100 is provided with a housing 30, the head portion 110, a buffer tank 60, an exhaust flow path portion 65, exhaust portions 70, a nozzle guard 40, and an exhaust guard 50 and the like. As shown in FIG. 4, the housing 30 is a box-shaped support, and supports the head portion 110 at the bottom portion. The housing 30 includes a support base 34, a middle housing 31, an upper housing 32, and a lower housing 33. The support base 34 is a plate-shaped member that is made of metal and has frame shape and is rectangular in a plan view, and has a through-hole (not shown in the drawings) formed in the center portion. The middle housing 31 has a rectangular tube shape that extends upward from the support base 34, and is fixed to the upper surface of the support base 34 at a position where a cylindrical hole in the middle housing 31 communicates with the through-hole in the support base 34. The upper housing 32 has a box shape that is open on the lower side. The upper housing 32 is provided so as to cover the buffer tank 60 (refer to FIG. 6 and FIG. 7) from the upper side, which is the side opposite the head portion 110, of the cylindrical hole in the middle housing 31. As shown in FIG. 4, the lower housing 33 is provided with a bottom surface 35 having opening, and has a box shape that is open on the upper side. The lower housing 33 is fixed to the lower surface of the support base 34 in a state in which the head portion 110 is exposed from below through the opening in the bottom surface 35.

Figure 5:
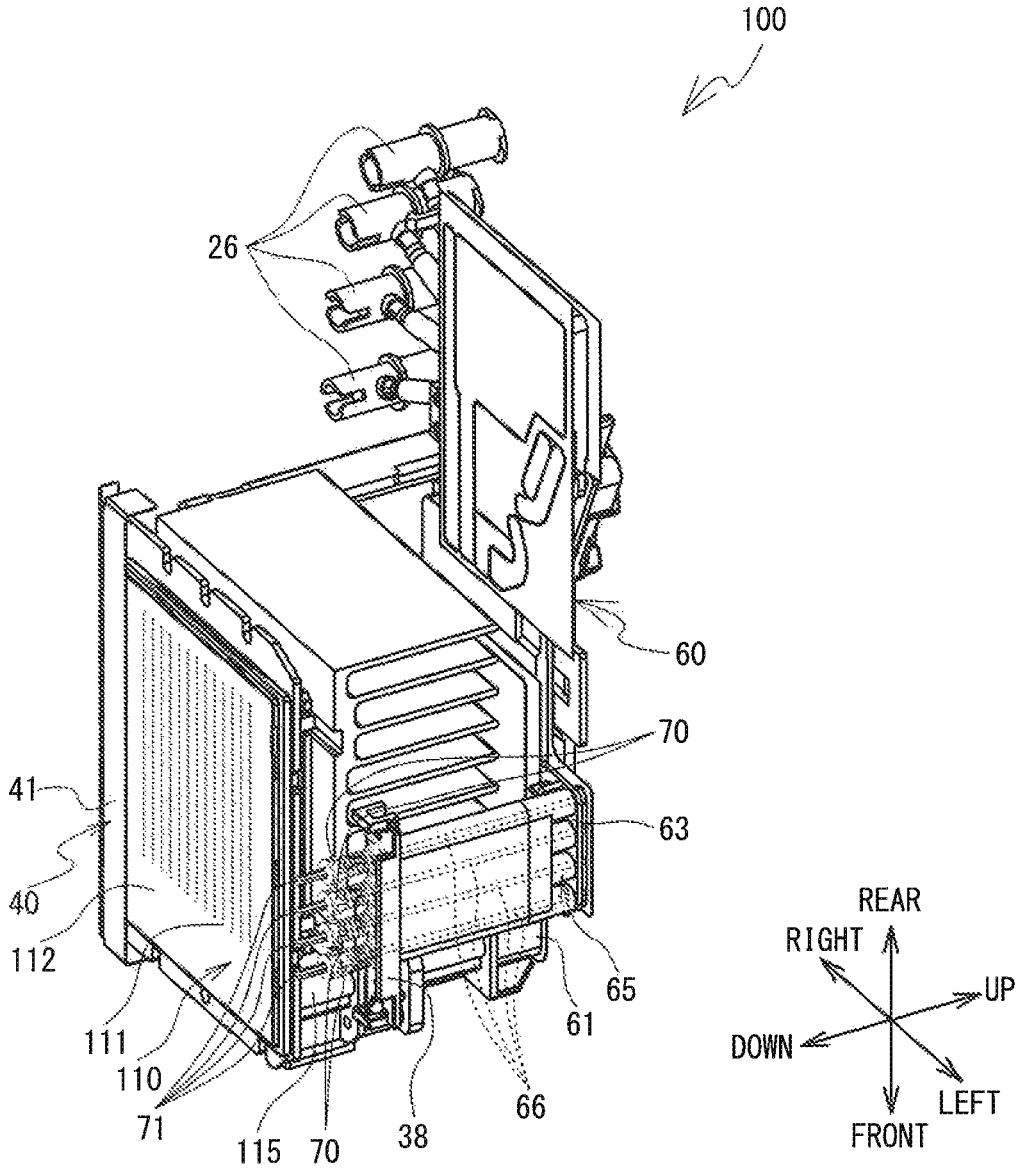
FIG. 5 is a perspective view of the inside of the first head unit.

As shown in FIG. 4 and FIG. 5, the head portion 110 is provided with the flat nozzle surface 112 having the plurality of nozzles 111 capable of ejecting ink downward. The head portion 110 is supported from above by the lower housing 33 in a state in which the nozzle surface 112 faces downward. The plurality of nozzles 111 are arranged extending in one row along the front-rear direction of the nozzle surface 112. The arrangement of the plurality of nozzles 111 is such that the plurality of such rows are lined up along the left-right direction. The nozzle surface 112 is a flat surface that is parallel to the horizontal direction, and forms the bottom surface of the head unit 100. Note that the inside of the head portion 210 is divided into four along the left-right direction so that each of the mutually different color inks in the head unit 200 can be selectively ejected. Since the head portion 110 has the same structure as the head portion 210, the inside of the head portion 110 is divided into four along the left-right direction.

Figure 6:
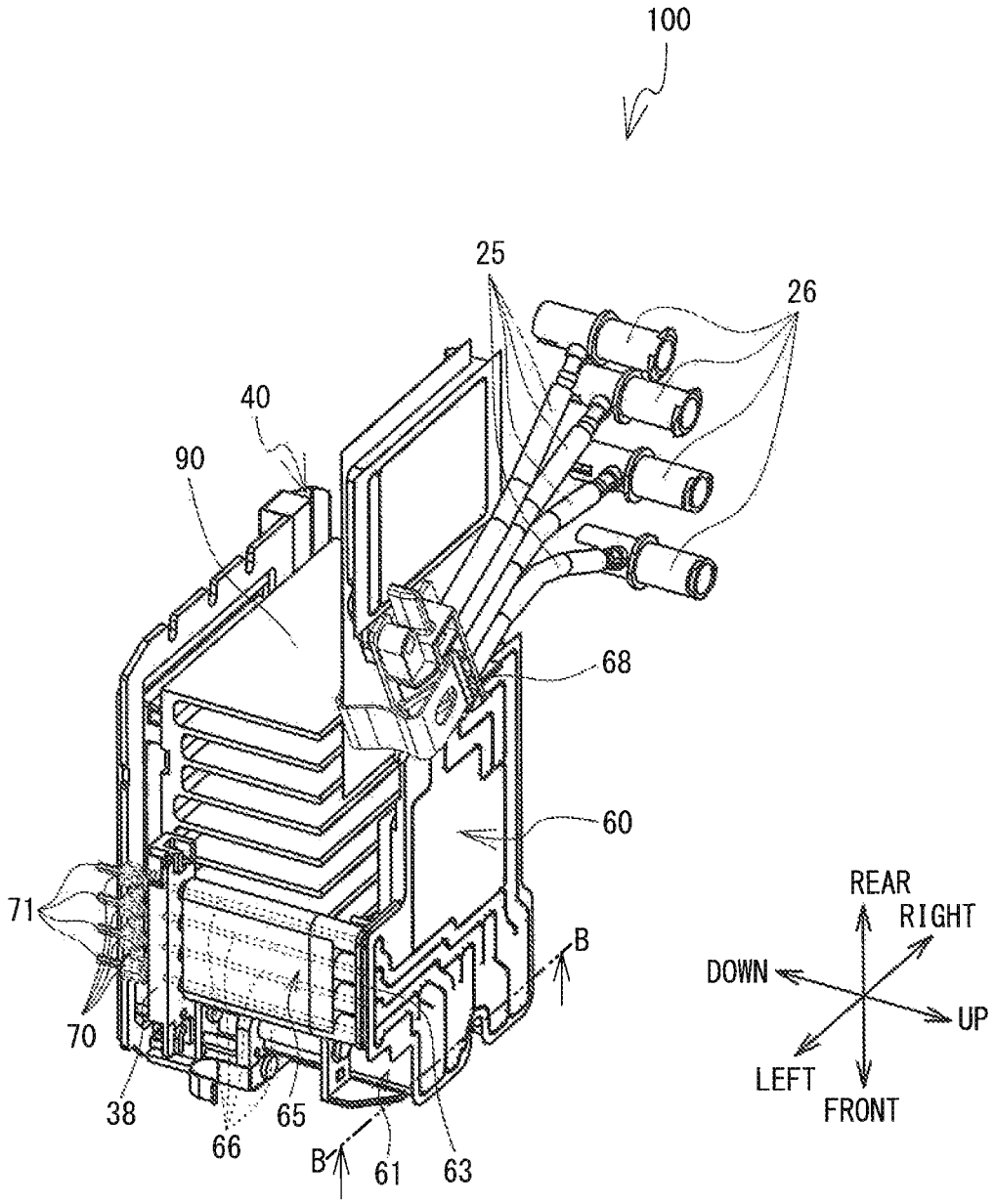
FIG. 6 is a perspective view of the inside of the first head unit.

As shown in FIG. 4 and FIG. 5, the buffer tank 60 has a hollow rectangular cuboid shape, and is formed extending parallel to the nozzle surface 112, in the upper portion of the head unit 100. As shown in FIG. 6, a tube joint 68 to which one end portion of each of four flexible tubes 25 is connected is provided on the upper surface of the buffer tank 60. In the head unit 100, the four tubes 25 supply white ink to the buffer tank 60 are connected to the tube joint 68. In the head unit 200, the four tubes 25 that supply each color ink of KYCM, to the buffer tank 60 are connected to the tube joint 68. A connecting unit 26 is provided on the other end portion, which is on the side opposite the one end portion, of each of the four tubes 25. The connecting units 26 connect the four tubes 25 and ink flow paths from the cartridges 131 to 136 (refer to FIG. 1) that store ink on the right side of the housing 2. The buffer tank 60 can store the ink in each of four storage chambers 61 (refer to FIG. 6) in order to supply the ink supplied from the four tubes 25 to the head portion 210. Note that the check valve units 150 shown in FIG. 2 are example of the connecting units 26. Although, the ink supply tubes 811 to 814 and the ink circulation tubes 821 to 824 are connected to the check valve units 150 shown in FIG. 2, in the connecting unit 26, the ink supply tubes 811 to 814 and the ink circulation tubes 821 to 824 are not connected to the connecting unit 26 but are connected to the flow paths on the upstream side of the connecting unit 26.

Figure 7:
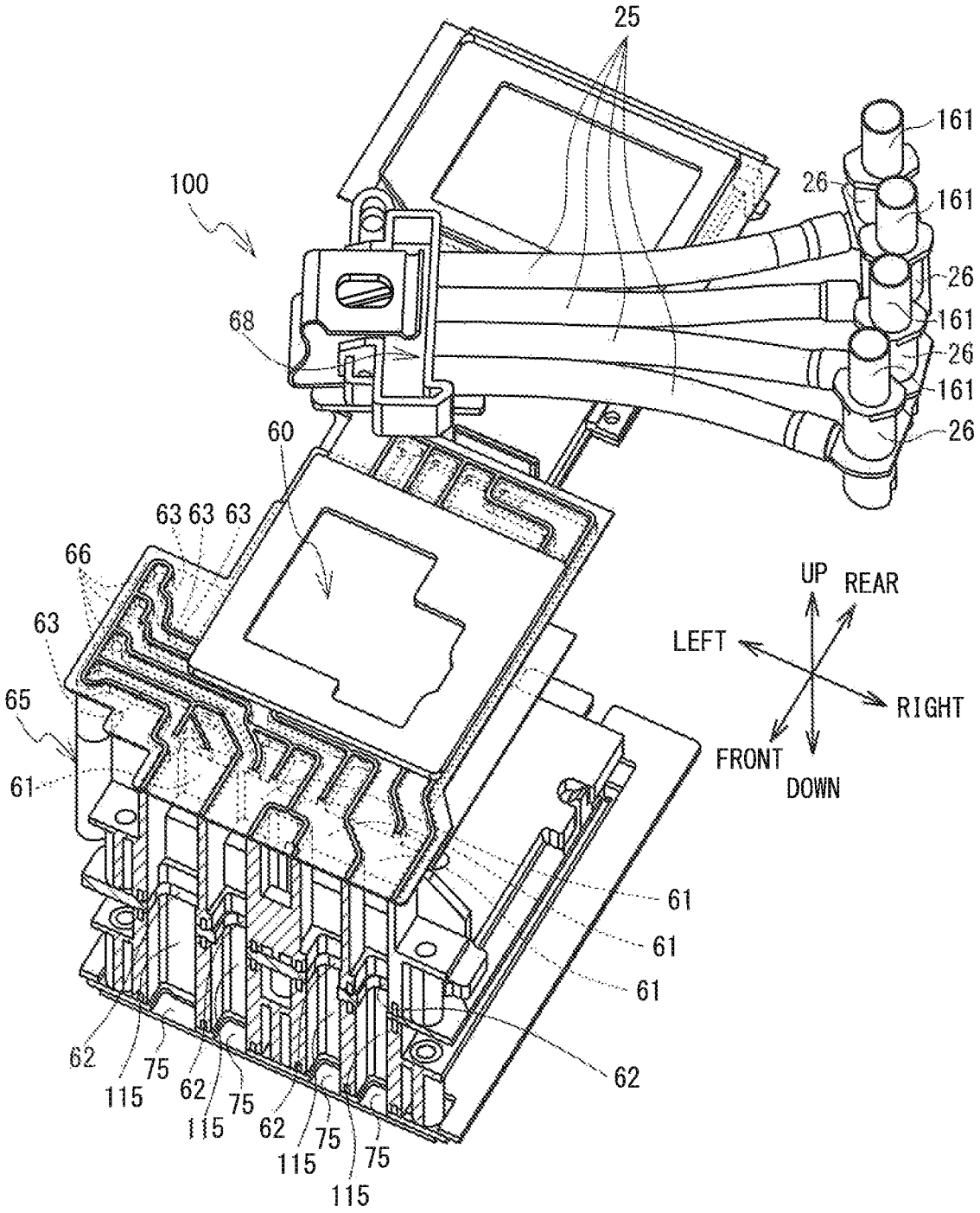
FIG. 7 is a partial sectional view in the direction of the arrows taken along line B-B in FIG. 6.

The buffer tank 60 temporary stores therein the ink supplied from the cartridges 131 to 136 (refer to FIG. 1) via the tubes 25 and the connecting units 26. Therefore, the buffer tank 60 supplies the ink to the head portion 110 after absorbing pressure fluctuation of the ink to be supplied to the head portion 110. As shown in FIG. 7, the buffer tank 60 is provided with a first outflow portion 62 and a second outflow portion 63. The first outflow portion 62 is provided on the lower side of the four storage chambers 61 in the front end portion of the buffer tank 60. The first outflow portion 62 is connected to four ink supply flow paths 115, described later, and supplies ink to the head portion 110. The second outflow portion 63 is provided in the left end portion of the buffer tank 60 and is connected to the exhaust flow path portion 65 without passing through the head portion 110. The buffer tank 60 stores bubbles of air or the like produced on the cartridge side and retained in the buffer tank 60 in the process of supplying ink, at the position of the second outflow portion 63.

As shown in FIG. 5 to FIG. 7, the exhaust flow path portion 65 has a rectangular cuboid shape that extends downward from the second outflow portion 63. The exhaust flow path portion 65 includes four hollow exhaust flow paths 66 that pass through the exhaust flow path portion 65 in the up-down direction. The upper end portions of the four exhaust flow paths 66 are communicated with the second outflow portion 63. The lower end portions of the four exhaust flow paths 66 are connected to the upper end portions of the four exhaust portions 70, respectively, that are arranged lined up in the front-rear direction at the same intervals as the four exhaust flow paths 66, in a base 38 provided on the lower housing 33. The four exhaust portions 70 are made of metal and have nozzle shapes, and are have therein flow paths that extend in the up-down direction, and an on-off valve (not shown in the drawings) is provided in each flow path. Four exhaust ports 71 that serve as outlets of the internal flow paths are provided at the lower end portions of the four exhaust portions 70. The four exhaust ports 71 are arranged lined up in the front-rear direction to the left side of the head portion 110 in the bottom surface 35.

As shown in FIG. 4, the nozzle guard 40 is a metal part that covers, in the front-rear direction, the right end portion of the bottom surface 35 and the right end portion of the head portion 110, and is formed separately from the lower housing 33. The nozzle guard 40 has a flat surface 41 that is parallel to the nozzle surface 112 and is disposed below the nozzle surface 112, and this flat surface 41 is disposed in a state where the right end portion of the bottom surface 35 and the right end portion of the head portion 110 are covered from below the nozzle surface 112. The exhaust guard 50 is a metal part that covers the left end portion of the bottom surface 35 along the front-rear direction, and is formed separately from the lower housing 33, similar to the nozzle guard 40. The exhaust guard 50 has a flat surface 51 that is parallel to the nozzle surface 112 and is disposed above the nozzle surface 112, and this flat surface 51 is disposed in a state where the left end portion of the bottom surface 35 is covered from below. Note that the right end portion of the flat surface 51 is disposed to the left of the left end portion of the head portion 110, and thus does not cover the left end portion of the head portion 110. Four openings 55 that are holes that pass through the flat surface 51 in the up-down direction are provided on the front side of the flat surface 51. The four openings 55 are formed slightly larger than each of the four exhaust ports 71, and are arranged lined up in the front-rear direction at the same intervals as the four exhaust ports 71. Therefore, the four exhaust ports 71 are exposed from below through the four openings 55.

As shown in FIG. 7, the head unit 100 is provided with the four ink supply flow paths 115 that are hollow flow path portions for supplying ink flowing out from the first outflow portion 62 to the head portion 110 (refer to FIG. 4 and FIG. 5). The four ink supply flow paths 115 are arranged in the left-right direction. The four ink supply flow paths 115 are disposed below the first outflow portion 62. The upper end portions of the four ink supply flow paths 115 are connected to the first outflow portion 62, and the lower end portions of the four ink supply flow paths 115 are connected to the head portion 110 (refer to FIG. 4). That is, the four ink supply flow paths 115 connect the buffer tank 60 to the plurality of nozzles 111 (refer to FIG. 4) of the head portion 110. A filter 75 that filters the ink is provided at each connecting portion of each of the ink supply flow paths 115 and the head portion 110. The filter 75 may be formed of a metal member such as nickel, or may be formed of a fibrous material such as a nonwoven fabric.

Electrical Configuration of the Printer 1

Figure 10:
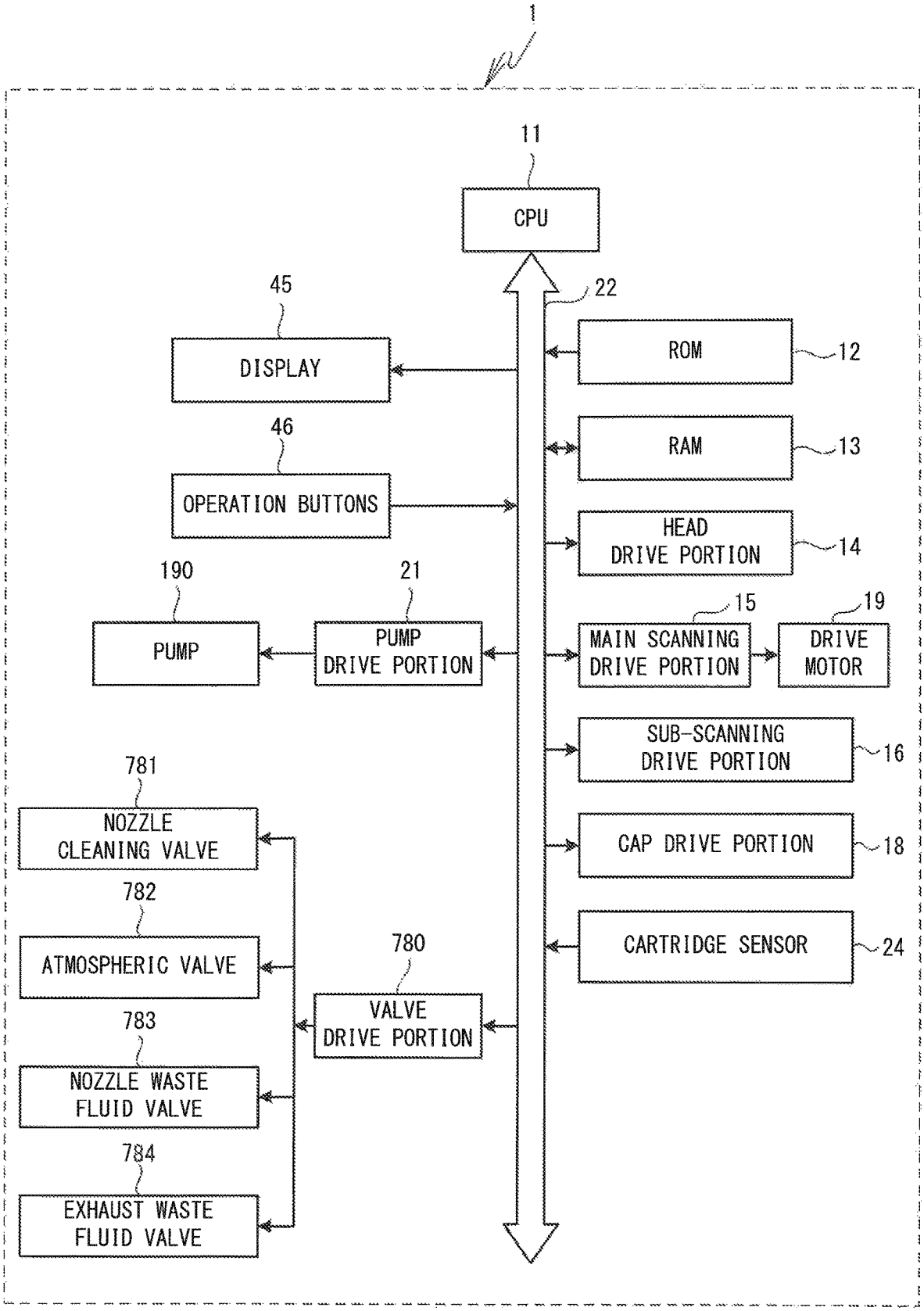
FIG. 10 is a diagram illustrating an electrical configuration of the printer.

As shown in FIG. 10, the printer 1 is provided with a CPU 11 that controls the printer 1. The CPU 11 is electrically connected, via a bus 22, to ROM 12, RAM 13, a head drive portion 14, a main scanning drive portion 15, a sub-scanning drive portion 16, a cap drive portion 18, the display 45, the operation buttons 46, a pump drive portion 21, a valve drive portion 780, and cartridge sensors 24.

A control program for the CPU 11 to control the operation of the printer 1, and initial values, and the like, are stored in the ROM 12. Various types of data used by the control program are temporarily stored in the RAM 13. The head drive portion 14 is electrically connected to the head portion 110 that ejects the ink, and causes the ink to be ejected from the nozzles 111 by driving piezoelectric elements provided in each of the ejection channels of the head portion 110 (refer to FIG. 2, FIG. 4, and FIG. 5).

The main scanning drive portion 15 includes the drive motor 19 and causes the carriage 20 to move in the left-right direction (main scanning direction). The sub-scanning drive portion 16 includes a motor and gears and the like, not shown in the drawings, and drives the platen drive mechanism 6 (refer to FIG. 1) so as to cause the platen 5 (refer to FIG. 1) to move in the front-rear direction (sub-scanning direction).

Figure 8:
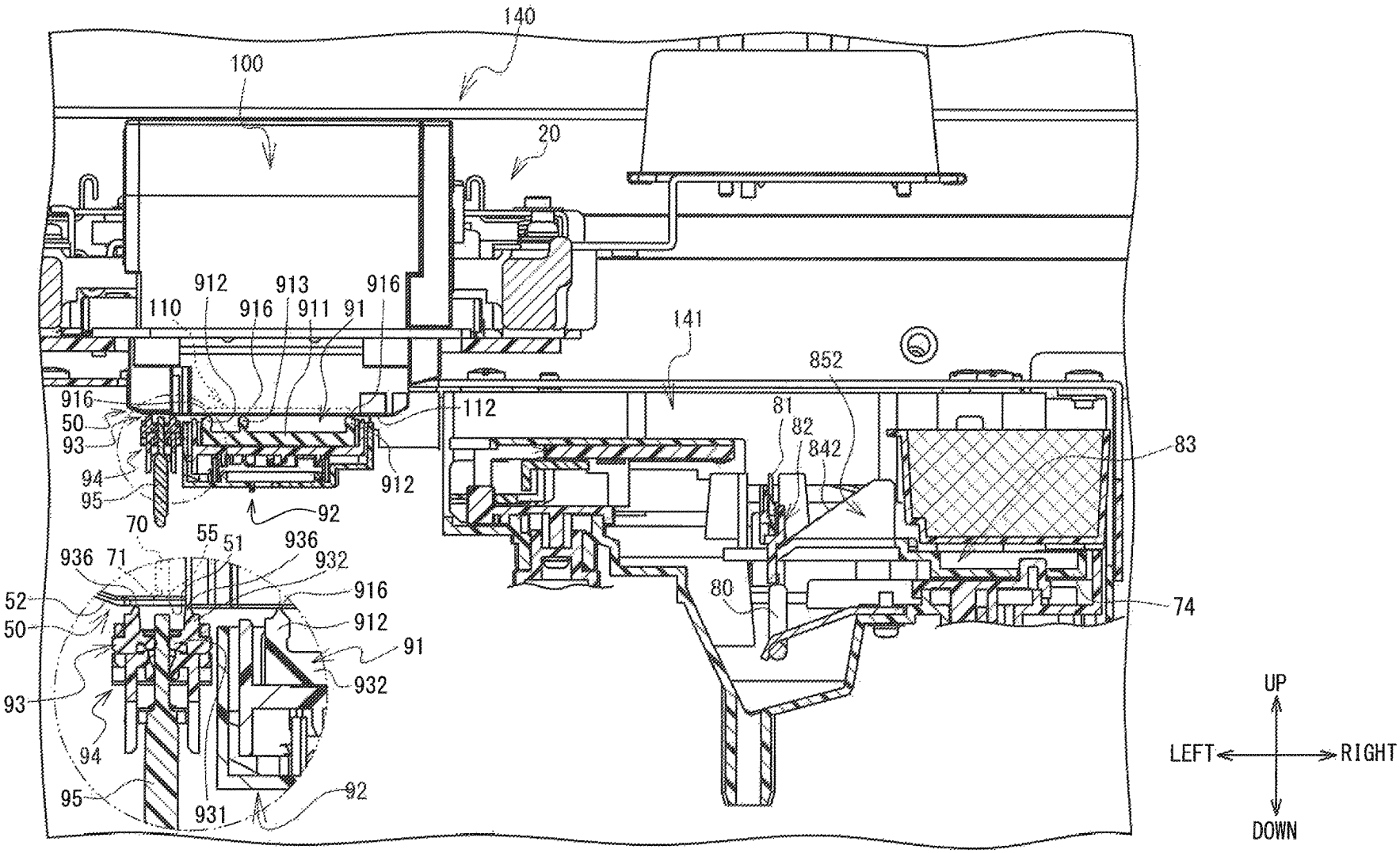
FIG. 8 is a sectional view in the direction of the arrows taken along line A-A in FIG. 3, and illustrates a state where purging is executed.

The cap drive portion 18 includes a cap drive motor (not shown in the drawings) and gears and the like, and, as shown in FIG. 8, causes a nozzle cap 91 and an exhaust cap 93 to move in the up-down direction by causing a nozzle cap support portion 92 and an exhaust cap support portion 94 to move in the up-down direction, as shown in FIG. 8. As a result of driving the cap drive portion 18, the nozzle cap support portion 92 and the exhaust cap support portion 94 of the maintenance portion 141, and the nozzle cap support portion 92 and the exhaust cap support portion 94 of the maintenance portion 142 simultaneously move up and down. Input from the operation buttons 46 is input to the CPU 11.

The cartridge sensors 24 are each provided on the mounting portion 3 and detect the mounting of the cartridges 131 to 136. The pump drive portion 21 controls the driving of a pump 190. The valve drive portion 780 controls the driving of a nozzle cleaning valve 781, an atmospheric valve 782, a nozzle waste fluid valve 783, and an exhaust waste fluid valve 784, which are electromagnetic valves.

Figure 9:
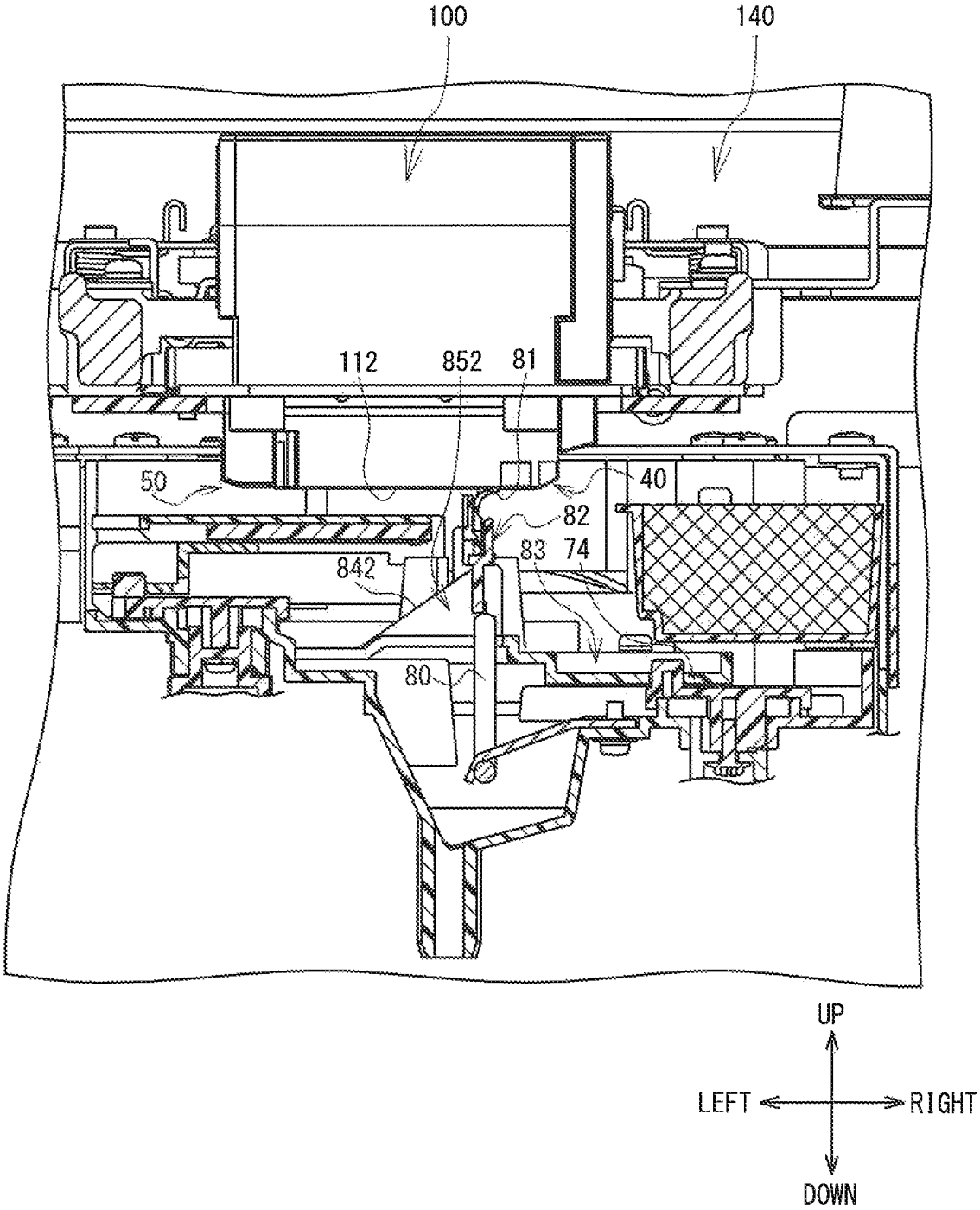
FIG. 9 is a sectional view in the direction of the arrows taken along line A-A in FIG. 3, and illustrates a state where nozzle surface wiping is executed.

The configuration and maintenance operation of the maintenance portions 141 and 142 will now be described with reference to FIG. 3, FIG. 8, and FIG. 9. In the maintenance portions 141 and 142, maintenance operations are performed with respect to the head units 100 and 200. The configuration and operation are the same for both of the maintenance portions 141 and 142, so in the description below, the description of the maintenance portion 142 will be omitted as appropriate.

The maintenance portion 141 is provided with the wiper 81, the nozzle cap 91, and the exhaust cap 93 and the like, as shown in FIG. 3 and FIG. 8. The wiper 81 is a flexible body that extends in the front-rear direction in substantially the center of the maintenance portion 141, and is provided below the nozzle surface 112 of the head unit 100 that has moved to the non-print area 140. The wiper 81 is made of a synthetic resin such as rubber. A wiper support portion 82 is provided on the lower side of the wiper 81 and supports the wiper 81. The lower portion of the wiper support portion 82 abuts against inclined portions 841 and 842 provided on a moving portion 83, and is able to move with respect to the inclined portions 841 and 842. The wiper support portion 82 is urged downward by a winding spring 80 fixed to the lower portion of the wiper support portion 82. The moving portion 83 includes facing wall portions 851 and 852, and a wall portion 74 (refer to FIG. 8). The pair of facing wall portions 851 and 852 face each other in the front-rear direction and have a generally triangular shape in a side view. The wall portion 74 is connected to a drive portion, not shown in the drawings, and moves in the left-right direction when driven by the drive portion. The wiper support portion 82 moves in the up-down direction along the inclined portions 841 and 842 as the moving portion 83 moves in the left-right direction.

As shown in FIG. 3, the nozzle cap 91 and the exhaust cap 93 are parts used in purging, and are provided on the left portion of the maintenance portion 141. The nozzle cap 91 is made of a synthetic resin such as silicon rubber, for example, and includes a bottom wall 911, a peripheral wall 912, and a partition wall 913. The nozzle cap 91 is disposed inside the nozzle cap support portion 92 that supports the nozzle cap 91. The nozzle cap support portion 92 has a rectangular box shape that is open on the upper side. The bottom wall 911 is a plate-like wall portion that extends in the horizontal direction and forms the lower portion of the nozzle cap 91, and has a rectangular shape that follows the inner surface of the nozzle cap support portion 92. The peripheral wall 912 is a wall portion provided on the upper side, i.e., the nozzle surface 112 side, of the nozzle cap 91, and extends upward from the periphery of the bottom wall 911. The peripheral wall 912 faces, in the up-down direction, the periphery of the area where the plurality of nozzles 111 are provided on the nozzle surface 112. Note that the nozzle cap 91 seals the plurality of nozzles 111 against outside air by covering the nozzle surface 112 during non-printing, and also serves to reduce the occurrence of poor printing by preventing the viscosity of the ink from rising due to the volatilization of the ink components inside the nozzles 111 or the like.

The partition wall 913 is a wall portion provided on the upper side, i.e., the nozzle surface 112 side, of the nozzle cap 91, and extends upward from the bottom wall 911. The partition wall 913 is provided between the center, in the left-right direction, and the left end portion of the bottom wall 911, and extends in the front-rear direction. The front end and the rear end of the partition wall 913 are connected to the front end portion and the rear end portion, respectively, of the peripheral wall 912. A cap lip 916 that is the upper end of the peripheral wall 912, and the cap lip 916 that is the upper end of the partition wall 913 are the same height in the up-down direction, and are positioned above the upper end of the nozzle cap support portion 92.

The exhaust cap 93 is made of a synthetic resin such as silicon rubber, for example, and includes a bottom wall 931 and a peripheral wall 932. The exhaust cap 93 is disposed inside the exhaust cap support portion 94 that supports the exhaust cap 93. The exhaust cap support portion 94 has a rectangular box shape that is open on the upper side. The bottom wall 931 is a plate-like wall portion that extends in the horizontal direction and forms the lower portion of the exhaust cap 93, and has a rectangular shape that follows the inner surface of the exhaust cap support portion 94 in a plan view. Four pins 95 that pass through the bottom wall 931 and extend in the up-down direction are arranged in the front-rear direction in the center, in the left-right direction, of the bottom wall 931. The peripheral wall 932 is a wall portion that is provided on the upper side, i.e., the flat surface 51 side of the exhaust guard 50, of the exhaust cap 93, and extends upward from the periphery of the bottom wall 931. The peripheral wall 932 faces, in the up-down direction, the periphery of the area where the four openings 55 are provided in the flat surface 51. A cap lip 936 that is the upper end of the peripheral wall 932 is the same height in the up-down direction all the way around, and is positioned above the upper end of the exhaust cap support portion 94.

The nozzle cap support portion 92 and the exhaust cap support portion 94 are connected to the cap drive portion 18 shown in FIG. 10, and move in the up-down direction when driven by the cap drive portion 18. The nozzle cap 91 and the exhaust cap 93 move up and down together with the nozzle cap support portion 92 and the exhaust cap support portion 94. As shown in FIG. 8, the nozzle cap 91 and the exhaust cap 93 that have moved upward are placed in close contact with the bottom portion of the head unit 100 that has moved to the non-print area 140. At this time, the cap lip 916 of the nozzle cap 91 is in close contact with the periphery of the area where the plurality of nozzles 111 are provided on the nozzle surface 112, so the nozzle cap 91 covers the plurality of nozzles 111. Also, the cap lip 936 of the exhaust cap 93 is in close contact with the periphery of the area where the four openings 55 are provided in the flat surface 51 of the exhaust guard 50, so the exhaust cap 93 covers the four openings 55 and the exhaust ports 71 positioned inside the four openings 55.

When the pump 190 is driven while connected to the nozzle cap 91 to perform a suction operation, air inside the sealed space between the nozzle cap 91 and the nozzle surface 112 is sucked out and the pressure consequently decreases. As a result, suction purging in which ink inside the head portion 110 is discharged from the plurality of nozzles 111 is executed. Depending on the type of components such as the synthetic resin contained in the ink, the ink may thicken or stick inside the nozzles 111 depending on the usage environment of the printer 1. By executing suction purging, the printer 1 can discharge foreign matter, such as ink that has thickened, from the plurality of nozzles 111, or air bubbles that have become mixed in inside the head portion 110, or the like from the plurality of nozzles 111 together with ink, thus making it possible to restore print quality.

The four pins 95 can move together as a single unit in the up-down direction while maintaining airtightness between the exhaust cap 93 and the flat surface 51 when the exhaust cap 93 is in close contact with the flat surface 51. When the four pins 95 move upward when the exhaust cap 93 is covering the exhaust ports 71 positioned inside the four openings 55, open valves provided in the exhaust portions 70 are pushed upward by the pins 95 and open, and as a result, flow paths inside the exhaust portions 70 open. When the pump 190 is driven while connected to the exhaust cap 93 to perform the suction operation in this open state, air in the sealed space between the exhaust cap 93 and the flat surface 51 is sucked out and the pressure consequently decreases. As a result, suction purging in which ink including bubbles that is stored in the buffer tank 60 is discharged through the exhaust ports 71 is executed. As a result of the exhaust purging being executed, the inside of the buffer tank 60 becomes filled with ink so a decrease in printing quality due to poor ejection of the ink is able to be prevented in the printer 1. Also, in the printer 1, by executing exhaust purging when initially introducing ink when the flow paths inside the exhaust portions 70 are open, as described above, for example, air in the buffer tank 60 is discharged through the exhaust ports 71 via the exhaust flow path portion 65 and the exhaust portions 70. Accordingly, ink is introduced from the cartridges 131 to 136 into the buffer tank 60 via the tubes 25 and the connecting units 26.

Figure 11:
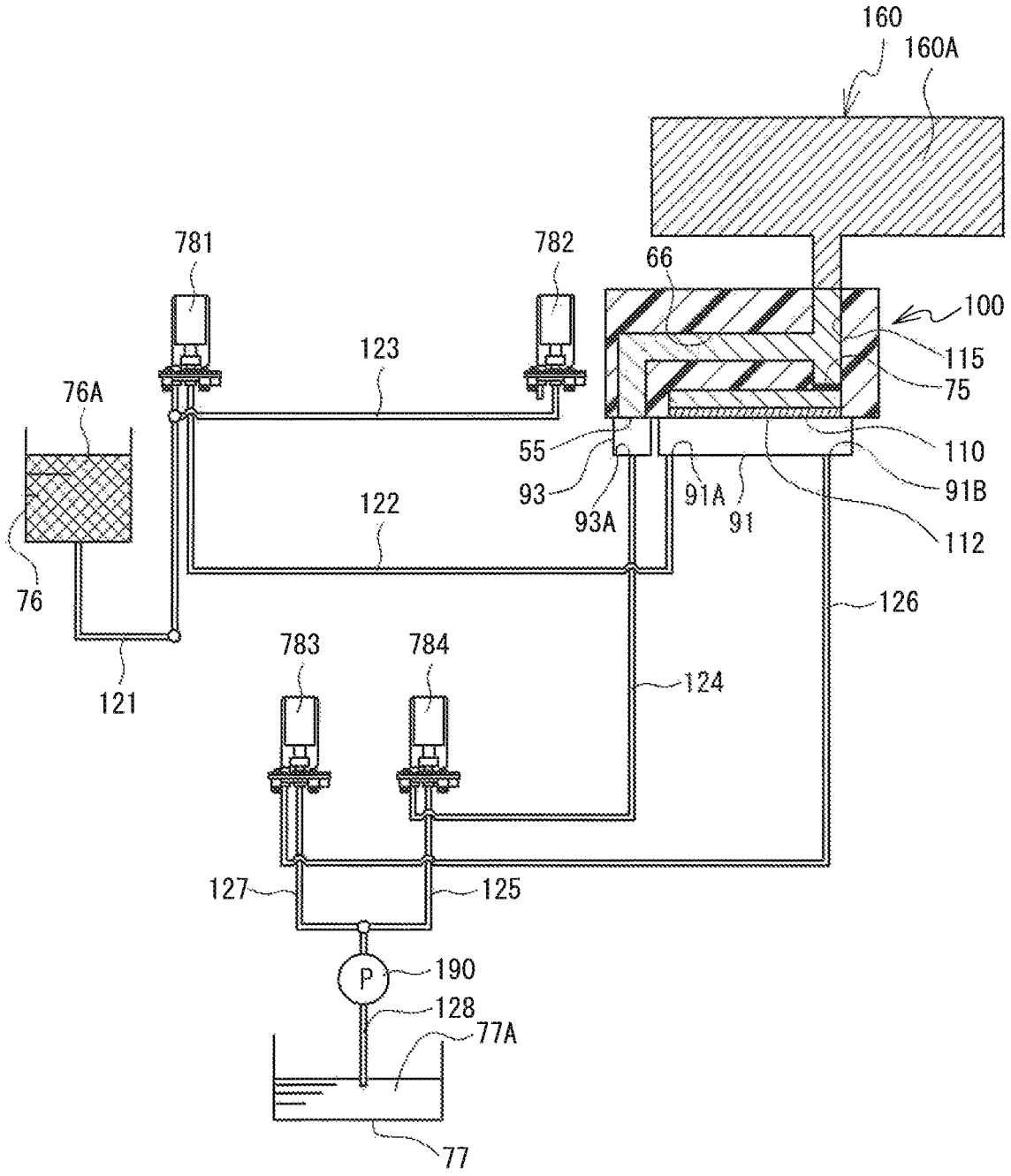
FIG. 11 is a chart of flow paths for cleaning fluid and ink.

The flow paths for supplying ink 160A to the head unit 100, and supplying and draining cleaning fluid 76A will be described with reference to FIG. 11. FIG. 11 shows the configuration simplified. Ink supply portions 160 formed by the cartridges 131 to 136, the ink supply tubes 811 to 818, and the check valve units 150 and the like is connected to the head unit 100. The exhaust flow paths 66 that serve as branch paths are communicated with the ink supply flow paths 115 upstream of the filter 75 and downstream of the ink supply portions 160. The openings 55 on the other end side of the exhaust flow paths 66 are open to the lower surface side of the head portion 110.

The cleaning fluid 76A for cleaning the nozzle surface 112 is stored in a cleaning fluid bottle 76. The cleaning fluid 76A contains at least glycerin. Using the cleaning fluid 76A that contains glycerin ensures moisture in the exhaust flow paths 66 compared to when using cleaning fluid 76A that does not contain glycerin, so the likelihood of poor printing is reduced. Also, the cleaning fluid 76A has lower viscosity than the ink 160A. Because the cleaning fluid 76A has lower viscosity than the ink 160A, the cleaning fluid 76A has higher fluidity than the ink 160A. Therefore, the cleaning fluid 76A removes deposits from the filter 75, so printing is less likely to become poor. The cleaning fluid bottle 76 and the nozzle cap 91 are connected by a cleaning fluid flow path 121 and a cleaning fluid flow path 122. The nozzle cleaning valve 781 that is an electromagnetic on-off valve is provided in a connecting portion where the cleaning fluid flow path 121 is connected to the cleaning fluid flow path 122. An atmospheric flow path 123 is connected to the cleaning fluid flow path 121. The atmospheric flow path 123 is opened and closed by the atmospheric valve 782 that is an electromagnetic on-off valve so as to be open or closed to the atmosphere.

As shown in FIG. 11, an inflow port 91A through which the cleaning fluid 76A flows in, and an outflow port 91B through which a fluid such as the ink 160A and the cleaning fluid 76A flows out are provided in the nozzle cap 91. One end portion of a waste fluid flow path 126 for discharging the fluid in the nozzle cap 91 is connected to the outflow port 91B. The other end portion of the waste fluid flow path 126 is connected to the nozzle waste fluid valve 783 that is an electromagnetic on-off valve. One end portion of a waste fluid flow path 127 is connected to the nozzle waste fluid valve 783. One end portion of the cleaning fluid flow path 122 is connected to the inflow port 91A. The other end portion of the cleaning fluid flow path 122 is connected to the nozzle cleaning valve 781.

An exhaust cap exhaust port 93A is provided in the exhaust cap 93, and one end portion of an exhaust waste fluid flow path 124 is connected to the exhaust cap exhaust port 93A. The exhaust waste fluid flow path 124 discharges gas and fluid from inside the exhaust cap 93. The other end portion of the exhaust waste fluid flow path 124 is connected to the exhaust waste fluid valve 784 that is an electromagnetic on-off valve. One end portion of the exhaust waste fluid flow path 125 is connected to the exhaust waste fluid valve 784. The other end portion of the waste fluid flow path 127 and the other end portion of the exhaust waste fluid flow path 125 merge and are connected to the pump 190. One end portion of the exhaust waste fluid flow path 128 is connected to the pump 190, and the other end portion of the exhaust waste fluid flow path 128 is connected to a waste fluid bottle 77 that stores waste fluid 77A.

Operation for Discharging Deposits on the Filter 75

Figure 12:
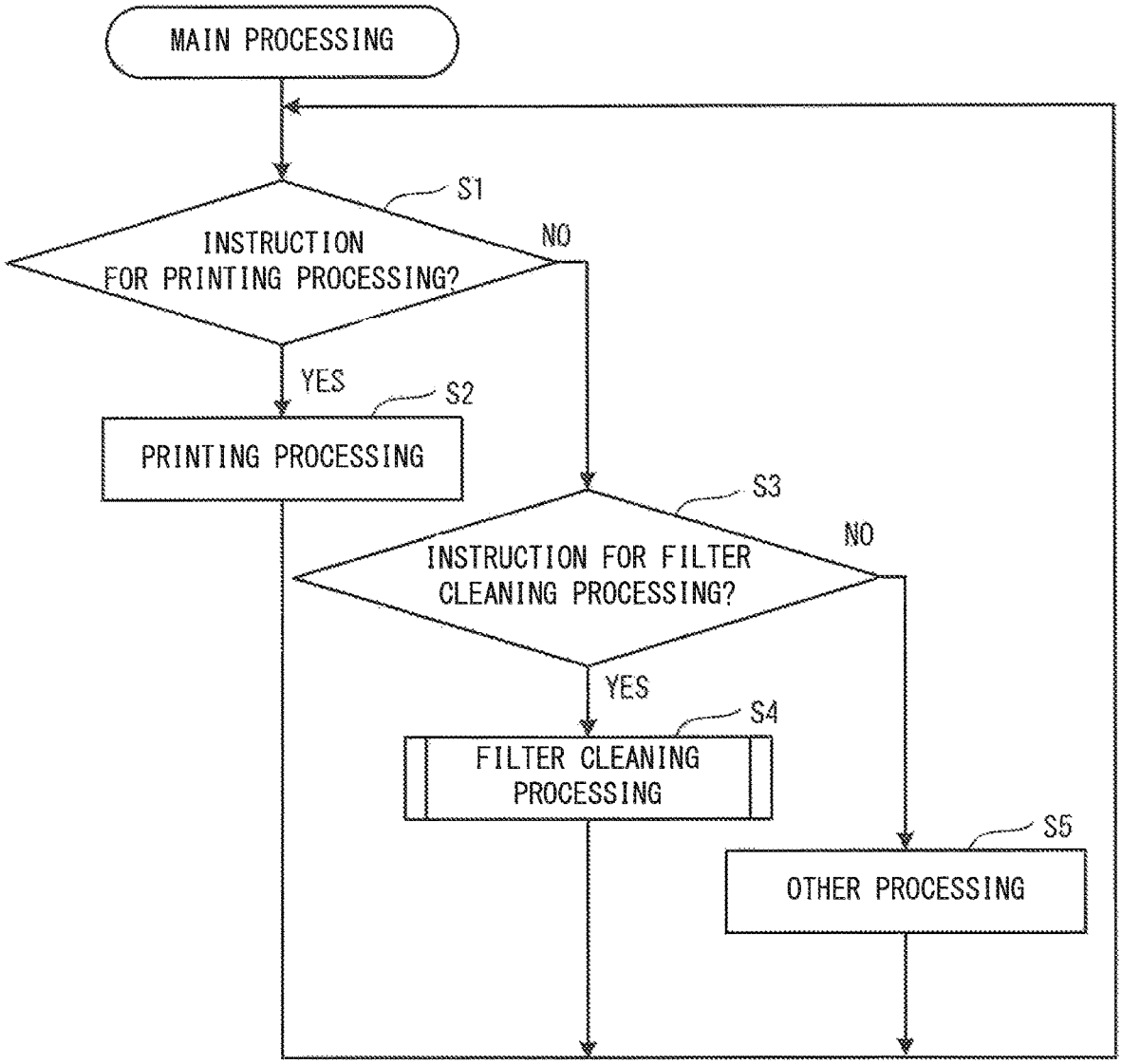
FIG. 12 is a flowchart of main processing.

Hereinafter, the operation for discharging deposits on the filter 75 will be described with reference to the flowchart of main processing of the printer 1 in FIG. 12, the flowchart of a subroutine of filter cleaning processing in FIG. 13, and FIG. 11, and FIG. 14 to FIG. 23.

When the power supply of the printer 1 is turned on, the CPU 11 reads and executes a main processing program from the ROM 12. The CPU 11 determines whether there is an instruction for print processing from a PC, not shown in the drawings, that is connected to the printer 1, or the operation buttons 46. If the CPU 11 determines that there is an instruction for print processing (yes at step S1), the CPU 11 then executes print processing (step S2). If the CPU 11 does not determine that there is an instruction for print processing (no at step S1), the CPU 11 then determines whether there is an instruction for filter cleaning processing from the PC or the operation buttons 46 (step S3). If the CPU 11 determines that there is an instruction for filter cleaning processing (yes at step S3), the CPU 11 executes the filter cleaning processing (step S4). The filter cleaning processing is executed in accordance with a subroutine of the filter cleaning processing shown in FIG. 13. If the CPU 11 does not determine that there is an instruction for the filter cleaning processing (no at step S3), the CPU 11 executes other processing (step S5), and moves the processing to the determination of step S1.

Figure 13:
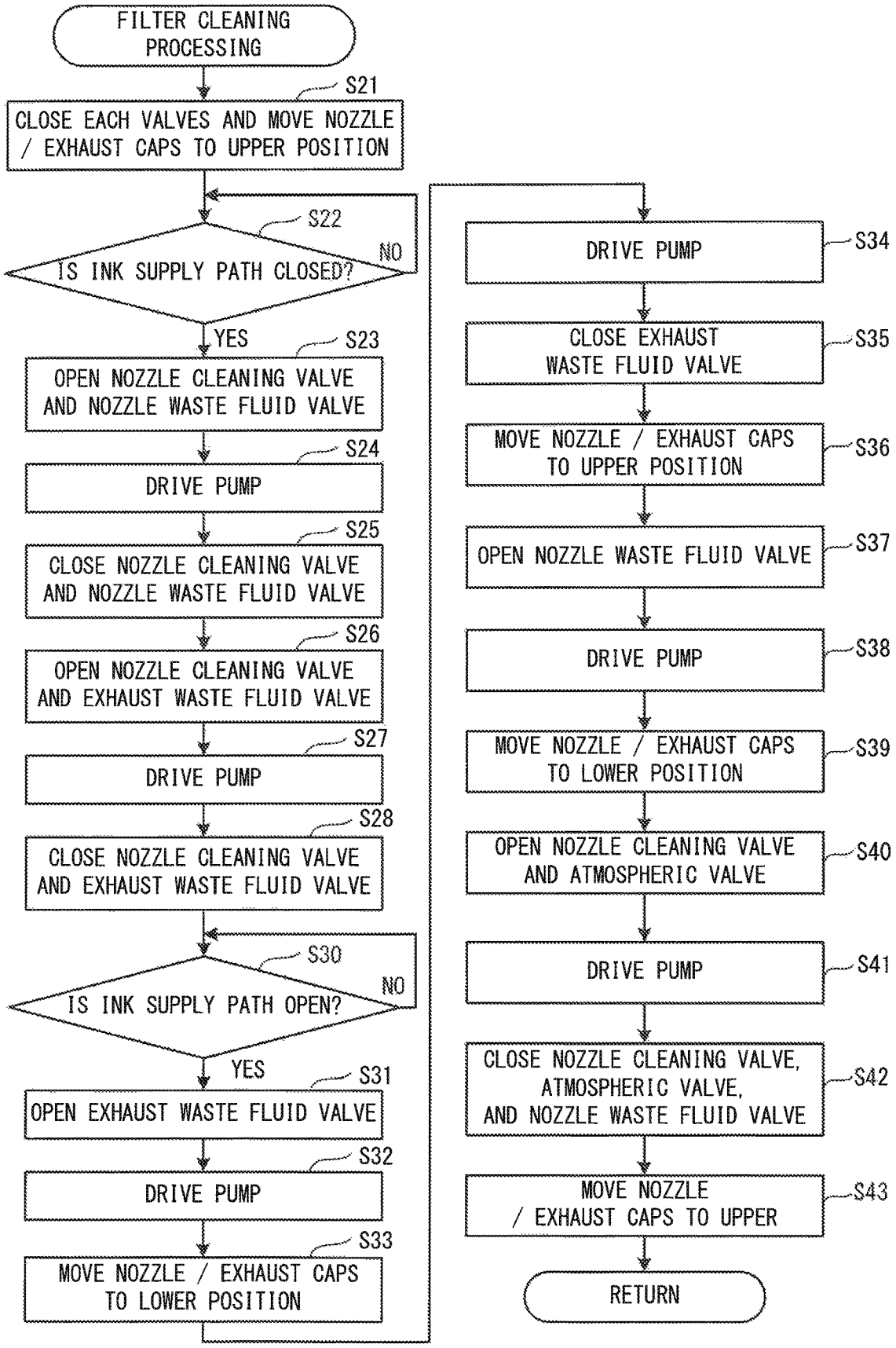
FIG. 13 is a flowchart of a subroutine of filter cleaning processing.
Figure 14:
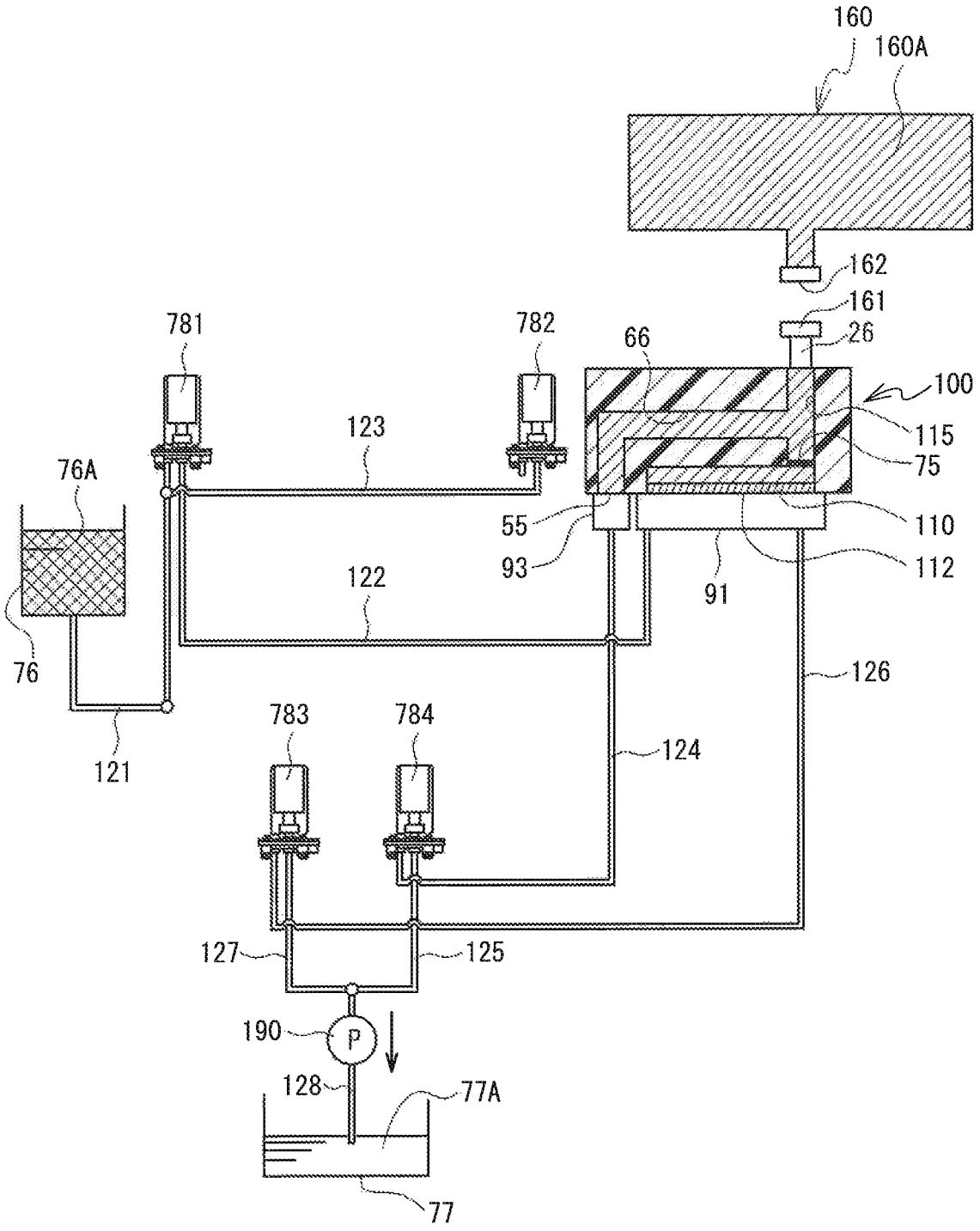
FIG. 14 is a chart of the flow paths for cleaning fluid and ink.

The filter cleaning processing (step S4) will now be described with reference to FIG. 13. First, the CPU 11 closes each of the nozzle cleaning valve 781, the atmospheric valve 782, the nozzle waste fluid valve 783, and the exhaust waste fluid valve 784. Also, the CPU 11 drives the cap drive portion 18 to move the nozzle cap support portion 92 and the exhaust cap support portion 94 to the upper position, thereby placing the nozzle cap 91 in close contact with the nozzle surface 112 and placing the exhaust cap 93 in close contact with the openings 55 of the exhaust flow paths 66 (step S21), as shown in FIG. 11.

Next, the CPU 11 determines whether there is via the operation buttons 46 input indicating that the ink supply paths are closed (step S22). The ink supply paths are closed by the user detaching the ink supply tubes 811 to 818 from the connecting units 26 (refer to FIG. 2), and attaching caps 162 that close off the ink supply portions 160 shown in FIG. 14, and caps 161 that close off the connecting units 26 (also refer to FIG. 7). After closing the ink supply paths, the user performs input via the operation buttons 46 indicating that the ink supply paths are closed. If there is input via the operation buttons 46 indicating that the ink supply paths are closed (yes at step S22), the CPU 11 opens the nozzle cleaning valve 781 and the nozzle waste fluid valve 783 (step S23). In this case, the atmospheric valve 782 and the exhaust waste fluid valve 784 remain closed. If there is no input indicating that the ink supply paths are closed (no at step S22), the CPU 11 returns the processing to step S22.

Figure 15:
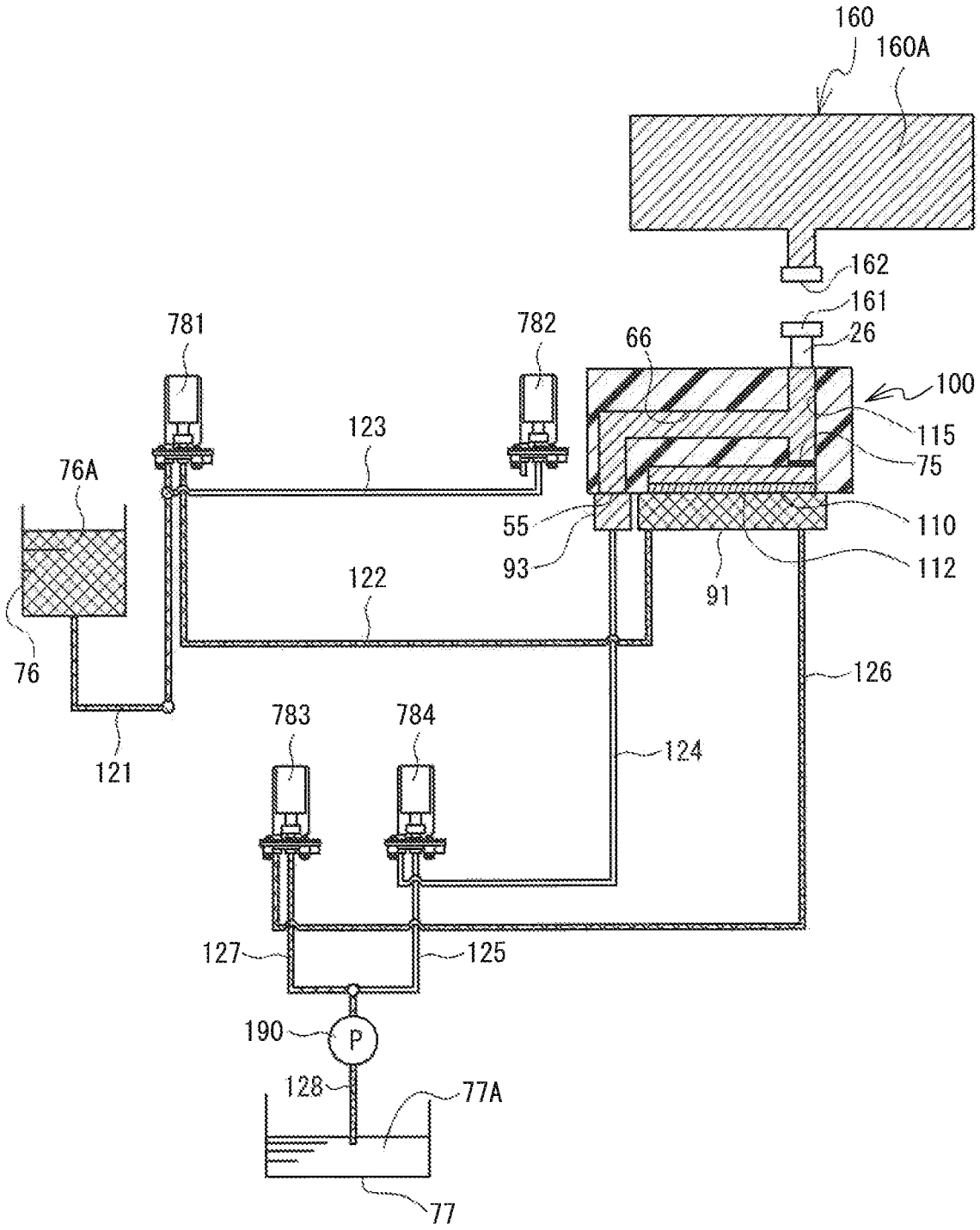
FIG. 15 is a chart of the flow paths for cleaning fluid and ink.

Following the processing of step S23, the CPU 11 drives the pump 190 for a certain period of time (step S24). The pump 190 functions as a sucking portion that sucks from an end side of the exhaust flow paths 66 opposite to the ink supply flow paths 115. Consequently, the pressure in the waste fluid flow paths 126 and 127, inside the nozzle cap 91, and in the cleaning fluid flow paths 121 and 122 becomes negative, such that the cleaning fluid 76A flows from the cleaning fluid bottle 76 into the nozzle cap 91 via the cleaning fluid flow path 121, the nozzle cleaning valve 781, and the cleaning fluid flow path 122, as shown in FIG. 15. Therefore, the inside of the nozzle cap 91 becomes filled with the cleaning fluid 76A, and the cleaning fluid 76A wets the nozzle surface 112. Then, the CPU 11 stops driving the pump 190.

Figure 16:
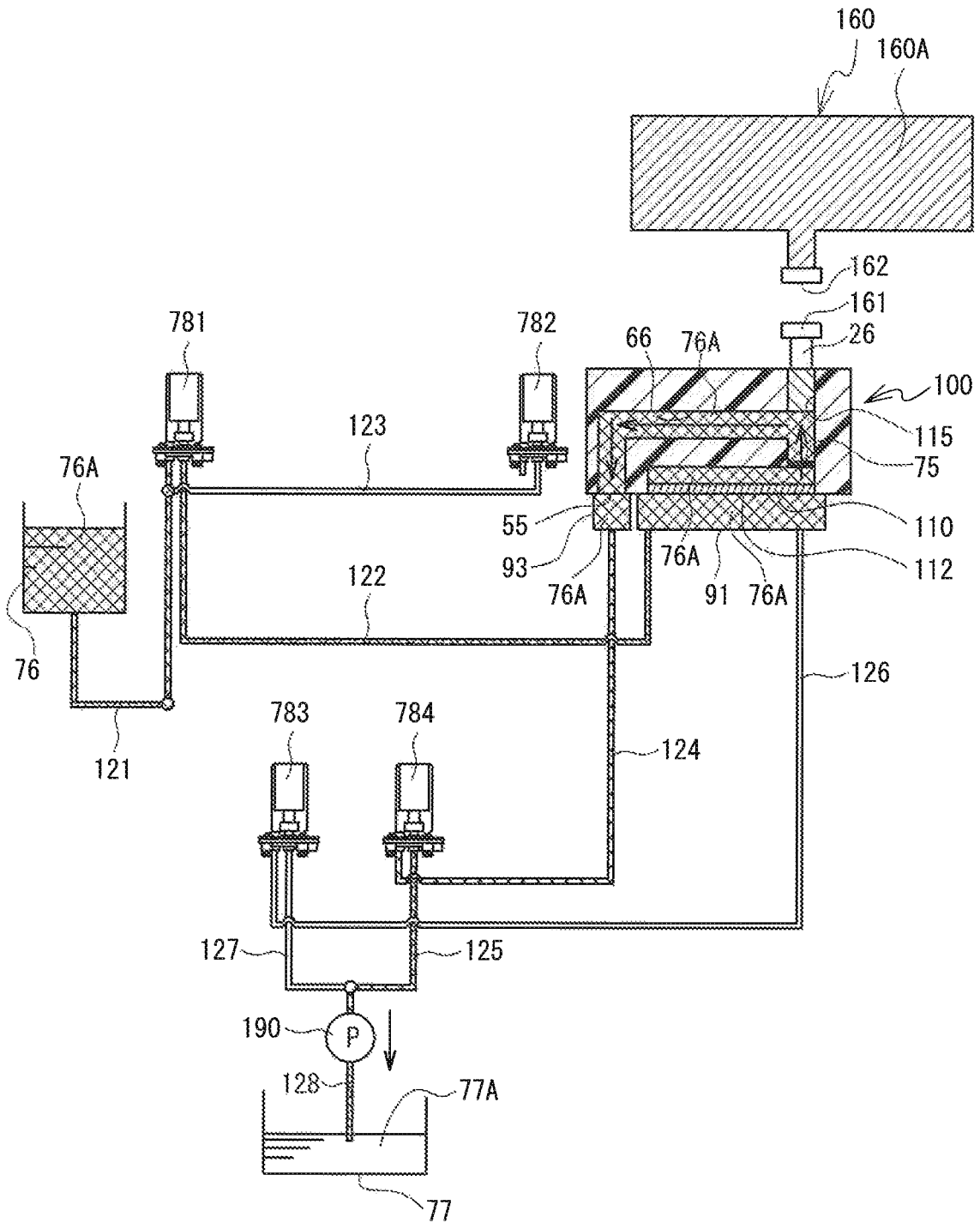
FIG. 16 is a chart of the flow paths for cleaning fluid and ink.

Next, the CPU 11 closes the nozzle cleaning valve 781 and the nozzle waste fluid valve 783 (step S25). Next, the CPU 11 opens the nozzle cleaning valve 781 and the exhaust waste fluid valve 784 (step S26). In this case, the atmospheric valve 782 and the nozzle waste fluid valve 783 remain closed. Next, the CPU 11 drives the pump 190 (step S27). The pressure in the exhaust waste fluid flow paths 124 and 125 and inside the exhaust cap 93 becomes negative, such that the cleaning fluid 76A flows from the cleaning fluid bottle 76 through the cleaning fluid flow path 121, the nozzle cleaning valve 781, the cleaning fluid flow path 122, the nozzle cap 91, the filter 75, the ink supply flow paths 115, the exhaust flow paths 66, the exhaust cap 93, and the exhaust waste fluid flow paths 124, 125, and 128 in this order, and then the cleaning fluid 76A is discharged into the waste fluid bottle 77, as shown in FIG. 16.

Therefore, deposits adhered to the filter 75 with the passage of the ink 160A will separate from the filter 75 by the passage of the cleaning fluid 76A that flows in the direction opposite the flow of the ink 160A at the time of printing, and be discharged from the openings 55 via the ink supply flow paths 115 and the exhaust flow paths 66. Therefore, the possibility of printing becoming poor due to these deposits becoming entrapped in the ink supply portions 160 upstream of the caps 161, and adhering to the filter 75 again, such that ink will no longer be able to sufficiently pass through the filter 75, decreases. After driving the pump 190 for a certain period of time, the CPU 11 stops driving the pump 190. The rotation speed of the pump 190 may be equal to or faster than the rotation speed when the ink 160A is introduced from the ink supply portions 160 into the ink supply flow paths 115 (steps S32 and S38). In this case, the ink supply flow paths 115 are closed off by the caps 161, such that the ink supply flow paths 115 and the ink supply portions 160 are separated. Therefore, even if the rotation speed of the pump 190 is set equal to or faster than the rotation speed when the ink is introduced, the cleaning fluid 76A will not flow from the ink supply flow paths 115 into the ink supply portions 160. Thus, it is possible to efficiently remove deposits on the filter 75.

Also, the rotation speed of the pump 190 may be slower than the rotation speed when the ink 160A is introduced from the ink supply portions 160 into the ink supply flow paths 115 (steps S32 and S38). In this case, the negative pressure in the exhaust cap 93 will become lower than it is when the ink 160A is introduced into the ink supply flow paths 115. Therefore, even if the ink supply flow paths 115 are not closed, the ink 160A will be less likely to flow from the ink supply portions 160 into the ink supply flow paths 115 and be wasted.

Next, the CPU 11 closes the nozzle cleaning valve 781 and the exhaust waste fluid valve 784 (step S28). Then, the CPU 11 displays on the display 45 that the ink supply paths are open. The ink supply paths are opened by removing the caps 162 that close off the ink supply portions 160, and removing the caps 161 from the connecting units 26 (refer to FIG. 5), and attaching the ink supply tubes 811 to 818 with the connecting units 26. After opening the ink supply path, the user performs input via the operation buttons 46 indicating that the ink supply paths are open. If there is input via the operation buttons 46 indicating that the ink supply paths are open (yes at step S30), the CPU 11 opens the exhaust waste fluid valve 784 (step S31). In this case, the nozzle cleaning valve 781, the atmospheric valve 782, and the nozzle waste fluid valve 783 remain closed. If there is no input indicating that the ink supply paths are open (no at step S30), the CPU 11 returns the processing to step S30.

Figure 17:
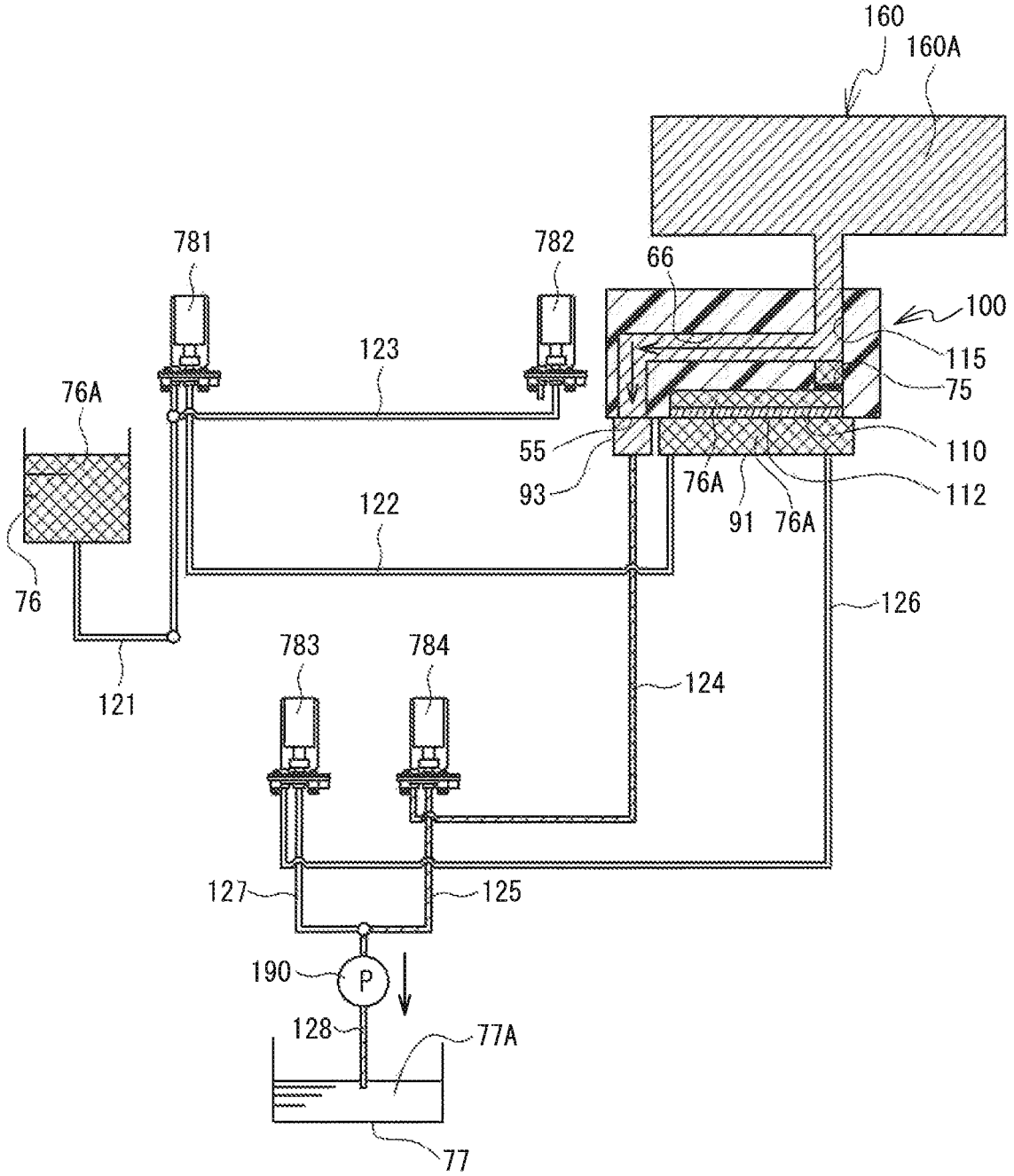
FIG. 17 is a chart of the flow paths for cleaning fluid and ink.

Following the processing of step S31, the CPU 11 drives the pump 190 (step S32). The pressure in the exhaust waste fluid flow paths 124 and 125 and inside the exhaust cap 93 becomes negative, such that the ink 160A flows from the ink supply portions 160 through the ink supply flow paths 115, the exhaust flow paths 66, and the exhaust waste fluid flow paths 124, 125, and 128, in this order, and then the ink 160A is discharged into the waste fluid bottle 77, as shown in FIG. 17. After driving the pump 190 for a certain period of time, the CPU 11 stops driving the pump 190.

Figure 18:
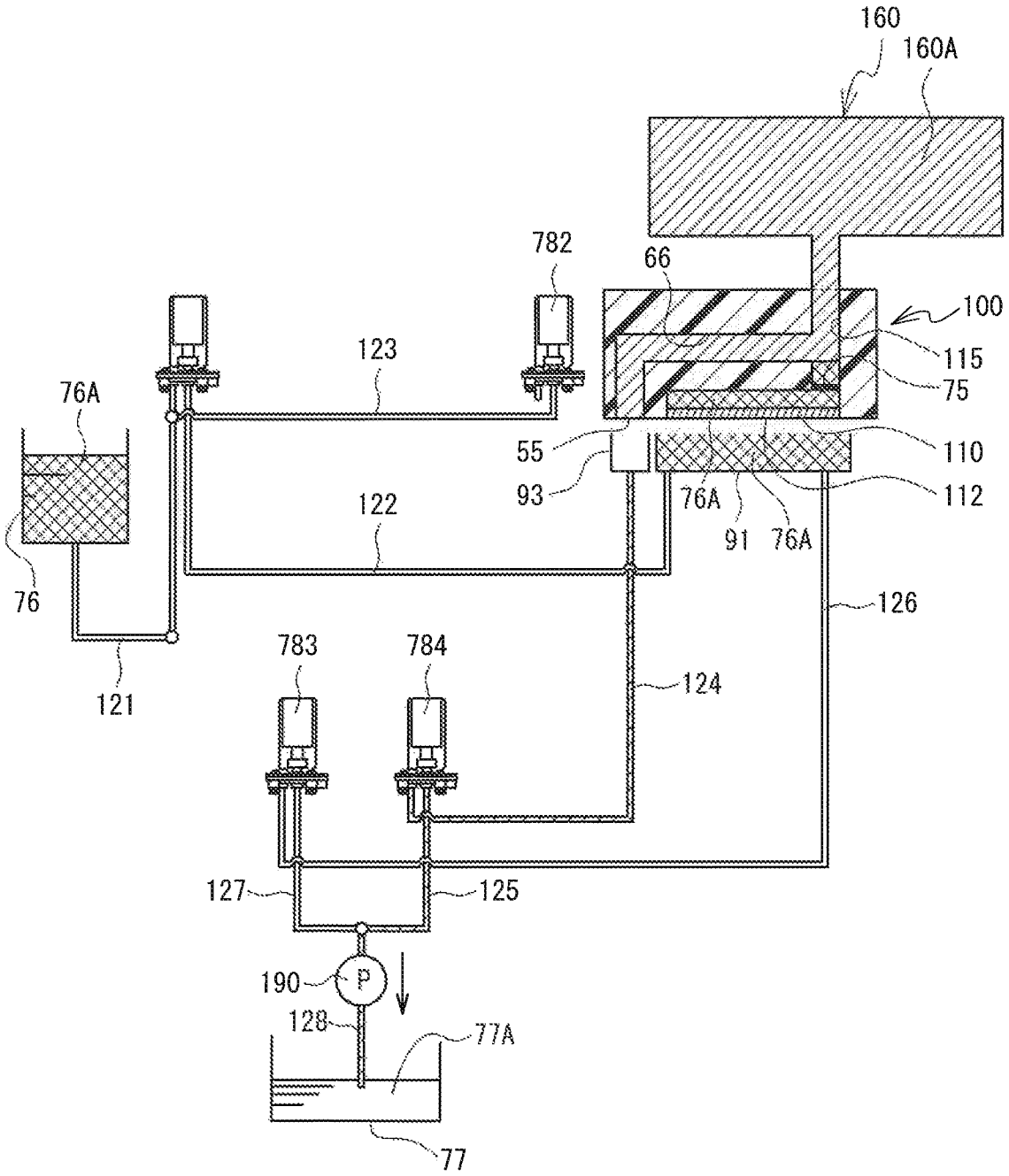

Next, the CPU 11 drives the cap drive portion 18 to move the nozzle cap support portion 92 and the exhaust cap support portion 94 to the lower position, thereby causing the nozzle cap 91 to separate from the nozzle surface 112 and causing the exhaust cap 93 to separate from the openings 55 of the exhaust flow paths 66 (step S33), as shown in FIG. 18.

Next, the CPU 11 drives the pump 190 (step S34). Therefore, the ink 160A or the cleaning fluid 76A inside the exhaust cap 93 is discharged into the waste fluid bottle 77. The waste fluid 77A that is a mixed fluid of the ink 160A and the cleaning fluid 76A accumulates in the waste fluid bottle 77. Next, the CPU 11 closes the exhaust waste fluid valve 784 (step S35). Accordingly, the nozzle cleaning valve 781, the atmospheric valve 782, the nozzle waste fluid valve 783, and the exhaust waste fluid valve 784 all become closed.

Figure 19:
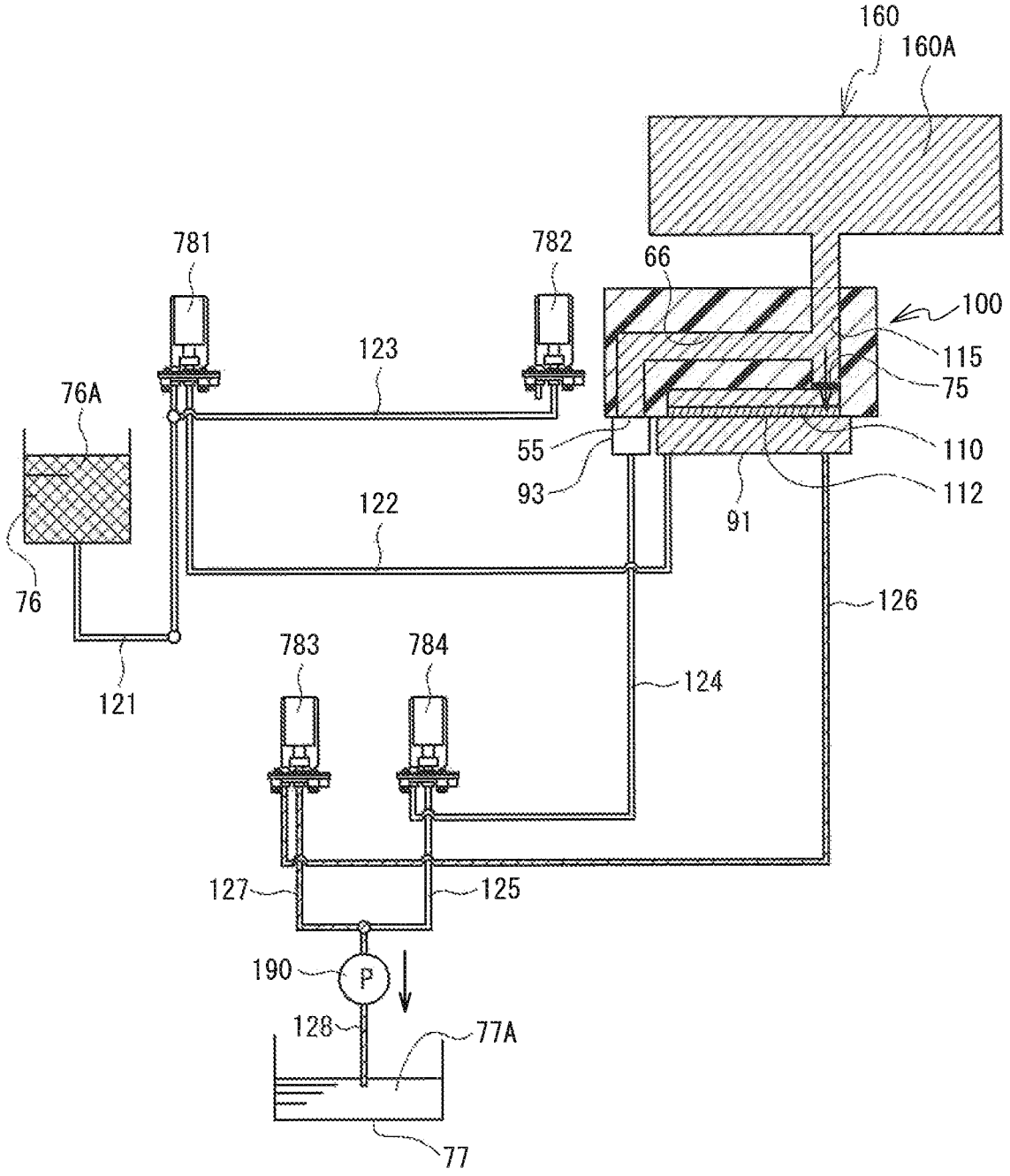
FIG. 19 is a chart of the flow paths for cleaning fluid and ink.

Next, the CPU 11 drives the cap drive portion 18 to move the nozzle cap support portion 92 and the exhaust cap support portion 94 to the upper position (step S36). The nozzle cap 91 is in close contact with the nozzle surface 112 and the exhaust cap 93 is in close contact with the openings 55 of the exhaust flow paths 66 (step S36), as shown in FIG. 19. Next, the CPU 11 opens the nozzle waste fluid valve 783 (step S37). Next, the CPU 11 drives the pump 190 (step S38). Accordingly, the pressure in the waste fluid flow path 126, the waste fluid flow path 127, and the nozzle cap 91 becomes negative, and the ink 160A is introduced into the ink supply flow paths 115 from the ink supply portions 160 (refer to FIG. 19).

Figure 20:
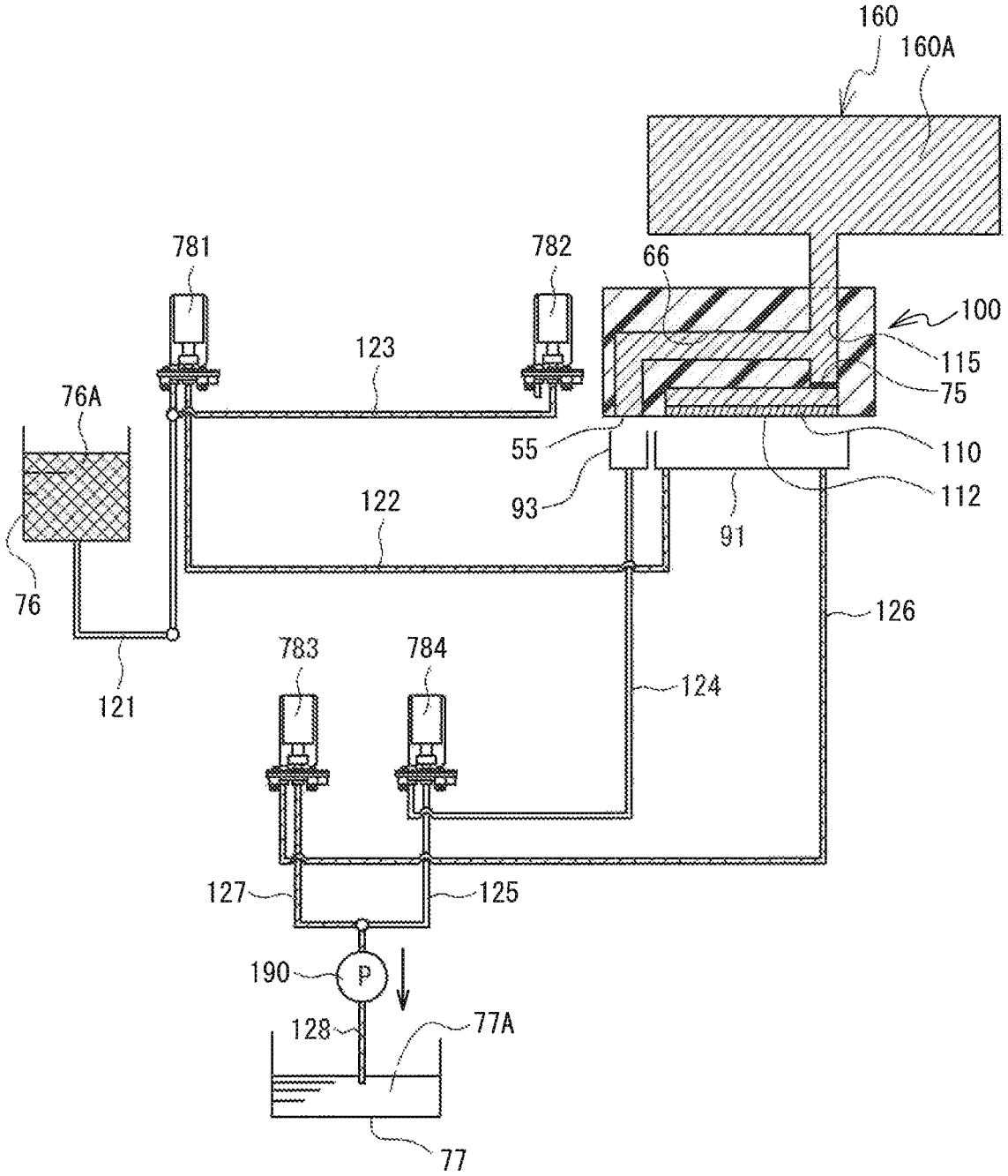
FIG. 20 is a chart of the flow paths for cleaning fluid and ink.

Next, the CPU 11 drives the cap drive portion 18 to move the nozzle cap support portion 92 and the exhaust cap support portion 94 to the lower position (step S39), as shown in FIG. 20. The nozzle cap 91 separates from the nozzle surface 112 and the exhaust cap 93 separates from the openings 55 of the exhaust flow paths 66. Next, the CPU 11 opens the nozzle cleaning valve 781 and the atmospheric valve 782 (step S40). Next, the CPU 11 drives the pump 190 (step S41). Accordingly, the pressure inside of the waste fluid flow path 126, the waste fluid flow path 127, and the nozzle cap 91 becomes negative, and the ink 160A or the cleaning fluid 76A inside the nozzle cap 91 is discharged into the waste fluid bottle 77. Next, the CPU 11 closes the nozzle cleaning valve 781, the atmospheric valve 782, and the nozzle waste fluid valve 783 (step S42). Next, the CPU 11 drives the cap drive portion 18 to move the nozzle cap support portion 92 and the exhaust cap support portion 94 to the upper position (step S43). Then, the CPU 11 advances the processing to the step S1 of the main processing.

As described above, in the printer 1 of the foregoing embodiment, deposits adhered to the filter 75 from the ink 160A passing through the filter 75 separate from the filter 75 due to the cleaning fluid 76A passing through the filter 75, and these deposits flow into the exhaust flow paths 66. These deposits are separated from the ink supply portions 160 on the upstream side of the caps 161. Thus, it is less likely that these deposits will become entrapped in the ink supply portions 160 upstream of the caps 161, and adhere to the filter 75 again, such that the ink 160A will no longer be able to sufficiently pass through the filter 75. Therefore, printing is less likely to become poor.

Also, because the cleaning fluid 76A that has passed through the filter 75 is discharged from the printer 1, the cleaning fluid 76A is reliably separated from the ink supply portions 160 on the upstream side of the caps 161, so printing is less likely to become poor.

The nozzles 111 of the head portion 110 are inflow ports for the cleaning fluid 76A, so deposits on the filter 75 can be removed, thus reducing the likelihood of printing becoming poor, without providing another inflow port in the head portion 110.

Also, the exhaust flow paths 66 are flow paths for exhausting the ink supply flow paths 115, and are used for the purpose of leading the ink 160A to the ink supply flow paths 115, and are also used when the cleaning fluid 76A flows out. Therefore, the apparatus can be simplified compared to when a flow path for the cleaning fluid 76A is formed separate from the exhaust flow paths 66.

Also, in the printer 1 described above, the ink supply flow paths 115 are closed off by the caps 161, such that the ink supply flow paths 115 and the ink supply portions 160 are separated. Therefore, even if the rotation speed of the pump 190 when the cleaning fluid 76A is injected into the ink supply flow paths 115 is set equal to or faster than the rotation speed when the ink 160A is introduced into the ink supply flow paths 115, the cleaning fluid 76A will not flow from the ink supply flow paths 115 into the ink supply portions 160. Thus, it is possible to efficiently remove deposits on the filter 75.

Also, in the printer 1 described above, the rotation speed of the pump 190 when the cleaning fluid 76A is injected into the ink supply flow paths 115 may be set slower than the rotation speed when the ink 160A is introduced from the ink supply portions 160 into the ink supply flow paths 115 (steps S32 and S38). In this case, the negative pressure in the exhaust cap 93 will become lower than it is when the ink 160A is introduced into the ink supply flow paths 115. Therefore, even if the ink supply flow paths 115 are not closed, the ink 160A will be less likely to flow from the ink supply portions 160 into the ink supply flow paths 115 and be wasted.

Also, with the printer 1 described above, the cleaning fluid 76A contains at least glycerin. Using the cleaning fluid 76A that contains glycerin ensures moisture in the exhaust flow paths 66 compared to when using cleaning fluid 76A that does not contain glycerin. Therefore, printing is less likely to become poor. Also, the cleaning fluid 76A has lower viscosity than the ink 160A. Because the cleaning fluid 76A has lower viscosity than the ink 160A, the cleaning fluid 76A has higher fluidity than the ink 160A. Therefore, the cleaning fluid 76A removes deposits from the filter 75, so printing is less likely to become poor.

Also, in the printer 1 described above, the ink 160A may include at least an emulsion. In this case, deposits resulting from the emulsion in the ink 160A are removed from the filter 75, so printing is less likely to become poor.

Also, in the printer 1 described above, the ink 160A includes at least a pigment. In this case, deposits resulting from the pigment in the ink 160A settling are removed from the filter 75, so printing is less likely to become poor.

Also, in the printer 1 described above, the white ink 160A includes at least titanium oxide. In this case, deposits resulting from the titanium oxide in the ink 160A settling are removed from the filter 75, so printing is less likely to become poor.

Also, the printer 1 described above is provided with the waste fluid bottle 77 that stores fluid from the exhaust flow paths 66, a plurality of head portions are provided, and separate exhaust flow paths 66 are provided for the plurality of head portions, and these may be communicated with each other before reaching the waste fluid bottle 77 and then communicated with the waste fluid bottle 77. In this case, the number of flow paths is reduced compared to a configuration in which the paths from the plurality of heads are separately communicated with the waste fluid bottle 77, so the flow path in the waste fluid bottle 77 is easier to manage, and printing is less likely to become poor.

Also, the cleaning fluid 76A passes through the head portion 110 from the nozzle surface 112 side to the ink supply flow paths 115 side, so foreign matter that is in the ink 160A and has accumulated in the head portion 110 will pass through the exhaust flow paths 66 from the filter 75 and be discharged out of the head portion 110. Thus, it is less likely that this foreign matter will become entrapped in the ink supply portions 160 upstream of the caps 161, and accumulate in the head portion 110 again, such that the head portion 110 will no longer be able to eject the ink 160A normally. As a result, printing is less likely to become poor.

Also, in addition to ink being supplied during normal printing, the ink 160A being purged and flushed, and the ink 160A and the cleaning fluid 76A being circulated, the cleaning fluid 76A passes through the filter 75 in the opposite direction from when printing is being performed, as described in this disclosure, so fluid is present in the exhaust flow paths 66 that exhaust when ink is introduced. Therefore, it is less likely that the ink 160A and the cleaning fluid 76A will dry in the exhaust flow paths 66, and the composition of the ink 160A and the cleaning fluid 76A will adhere to the inside surface of the exhaust flow paths 66, such that the flow of the ink 160A and the cleaning fluid 76A will be impeded. Also, when there is a movable valve or the like in the exhaust flow paths 66, the operation of that movable valve is less likely to be impeded.

Figure 21:
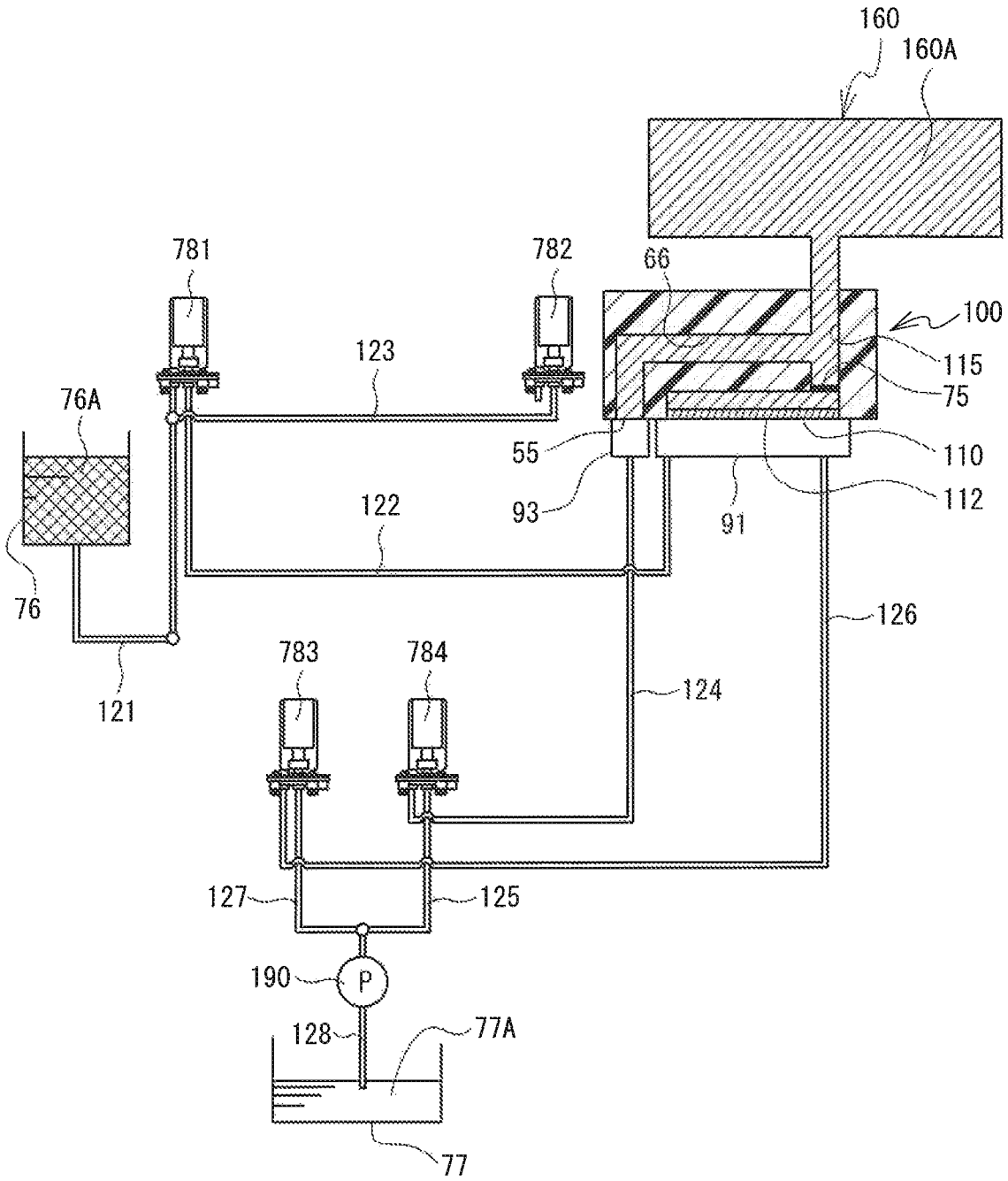
FIG. 21 is a chart of the flow paths for cleaning fluid and ink.

The present disclosure is not limited to the embodiment described above; various modifications may be made without departing from the scope of the present disclosure. For example, with regards to the filter cleaning processing (step S4), the order of the steps in the filter cleaning processing shown in FIG. 13 is not limited to the order described. For example, the processing may be performed as described below. In the initial state, the CPU 11 drives the cap drive portion 18 to move the nozzle cap support portion 92 and the exhaust cap support portion 94 to the upper position, thereby placing the nozzle cap 91 in close contact with the nozzle surface 112 and placing the exhaust cap 93 in close contact with the openings 55 of the exhaust flow paths 66, as shown in FIG. 21. Also, the CPU 11 closes all of the nozzle cleaning valve 781, the atmospheric valve 782, the nozzle waste fluid valve 783, and the exhaust waste fluid valve 784.

Figure 22:
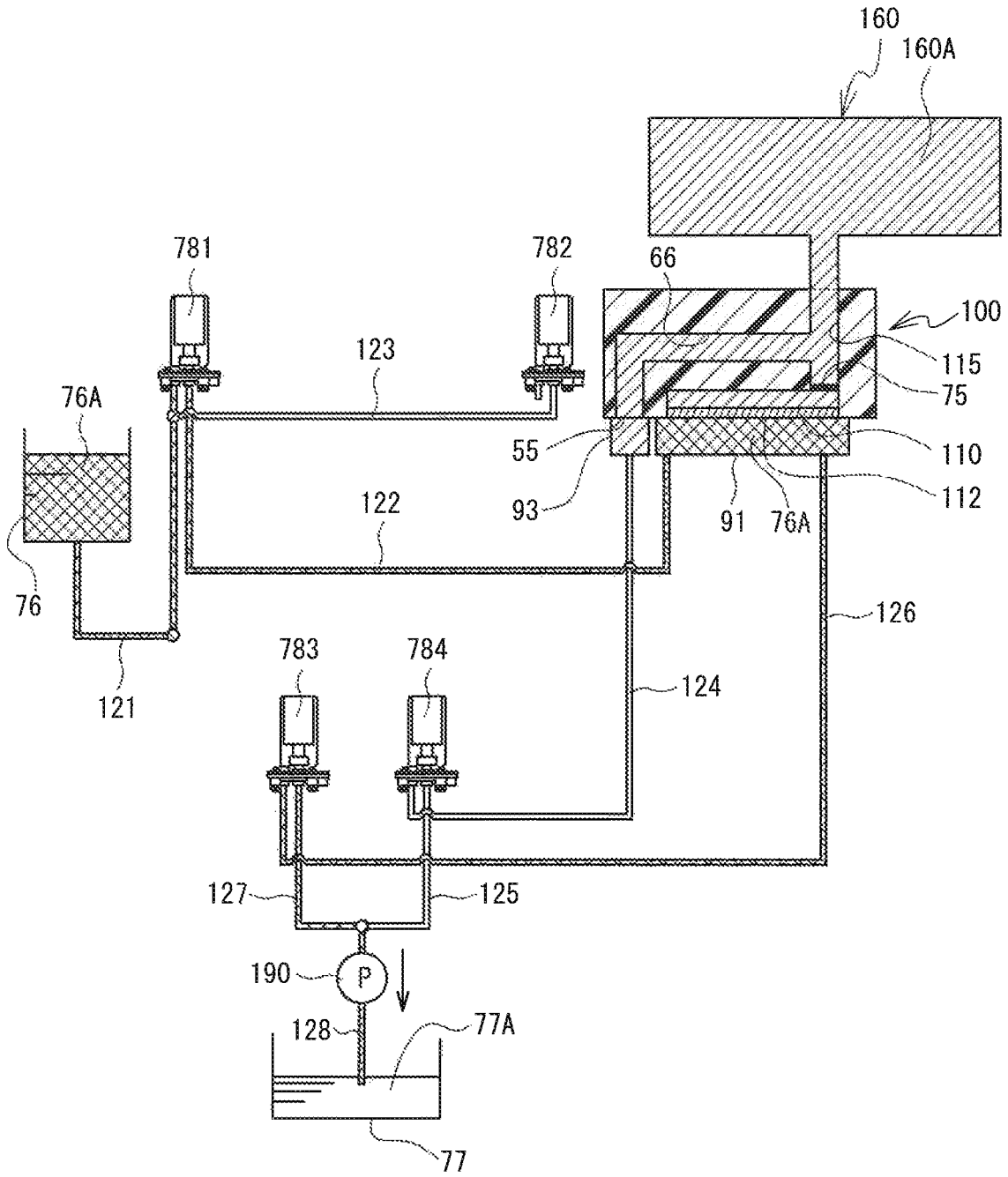
FIG. 22 is a chart of the flow paths for cleaning fluid and ink.
Figure 23:
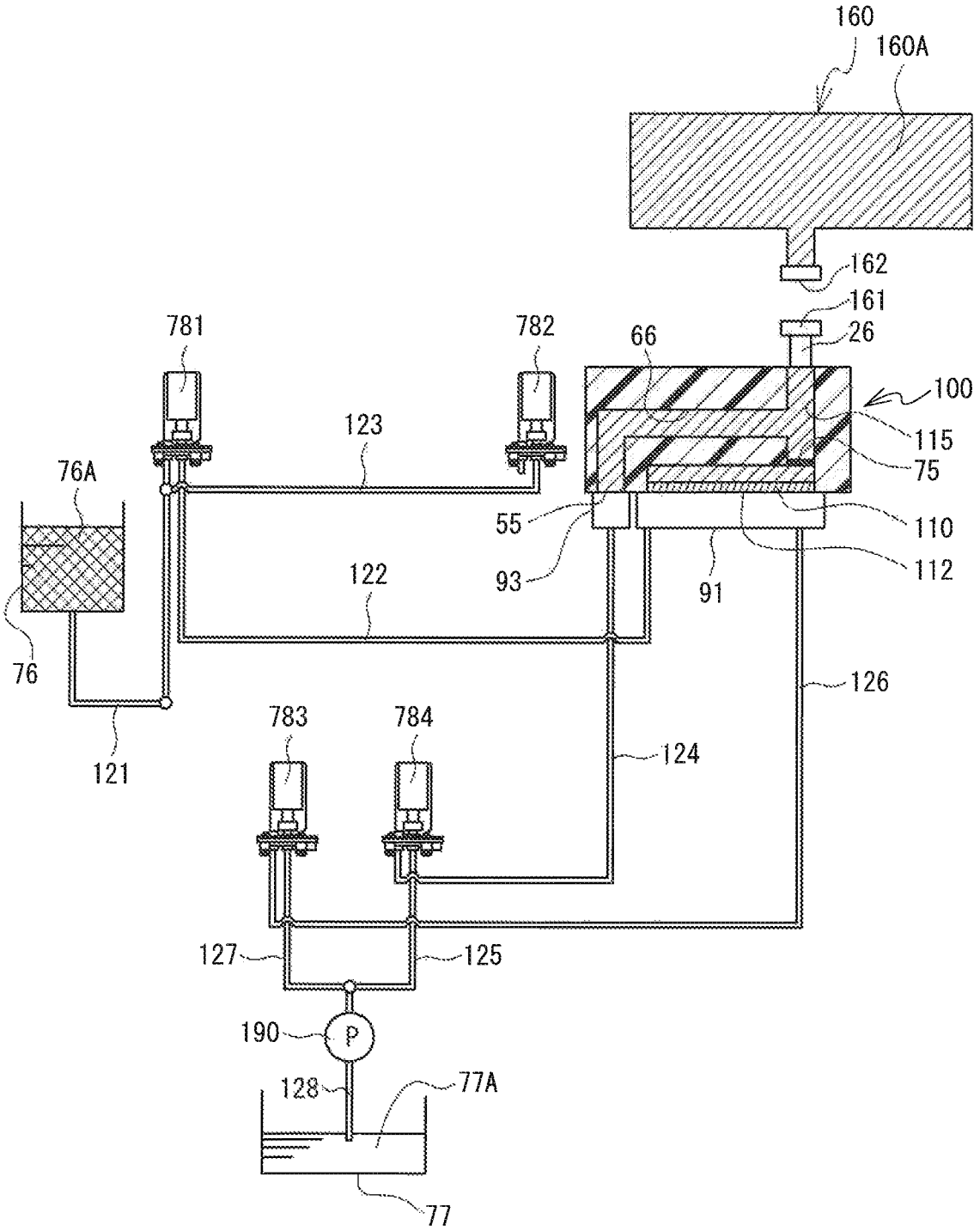
FIG. 23 is a chart of the flow paths for cleaning fluid and ink.

Next, the CPU 11 opens the nozzle cleaning valve 781 and the nozzle waste fluid valve 783, as shown in FIG. 22. Next, the CPU 11 operates the pump 190 and fills the closed space obtained by the nozzle cap 91 being in close contact with the nozzle surface 112, with the cleaning fluid 76A. Next, the CPU 11 closes the nozzle cleaning valve 781 and the nozzle waste fluid valve 783. Next, as shown in FIG. 23, the user attaches the caps 162 that close off the ink supply portions 160, and the caps 161 that close off the connecting units 26. Then, the CPU 11 may perform the processing of steps S26 to S43 of the filter cleaning processing shown in FIG. 13. Also, as the first opening/closing portion of the present disclosure, instead of the caps 161, a pouch as a sub-tank disposed in the ink supply paths between the cartridges 131 to 136 and the head portions 110 and 210 may be manually replaced by the user with a pouch not filled with ink (a pouch in which the ink supply flow paths are closed off by the inside wall of the pouch being in close contact with the ink supply flow paths due to there being no ink in the pouch). Also, as the first opening/closing portion, electromagnetic on-off valves may be provided instead of the caps 161, and the opening and closing of these electromagnetic on-off valves may be controlled by the CPU 11.

In the configuration described above, the exhaust portion 70 is made of metal and has a nozzle shape, and the exhaust ports 71 and the open valves are provided in the exhaust portion 70. However, the configuration related thereto is not limited. For example, the exhaust portion 70 may be formed by an elongated shaft-like part that is not hollow. In this case, the shaft-like member has a stepped portion. Donut-shaped packing is fixed to the exhaust flow paths 66. The shaft-like member is slidably disposed in the exhaust flow path 66. The stepped portion of the shaft-like member is disposed so as to be pressed against the packing by a compression spring. The lower end of the shaft-like part is moved upward by the pin 95, similar to the exhaust portions 70. In the foregoing configuration, the check valve units 150A, 150B, 150C, and 150D are provided, but they do not necessarily have to be provided. In the foregoing embodiment, the cap drive portion 18 functions as both a nozzle cap drive mechanism and an exhaust cap drive mechanism, but the nozzle cap drive mechanism and the exhaust cap drive mechanism may be formed by separate drive mechanisms.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An image-forming apparatus comprising:

a first fluid supply path configured to supply a first fluid from one side of a discharge outlet of a head;

a first opening/closing portion configured to open and close the first fluid supply path;

a filter disposed in the first fluid supply path upstream of the discharge outlet of the head and downstream of the first opening/closing portion, and configured to filter the first fluid to be supplied to the discharge outlet of the head;

a branch path communicated with the first fluid supply path upstream of the filter and downstream of the first opening/closing portion;

a second fluid supply path configured to supply a second fluid from the other side that is the side opposite the one side of the discharge outlet;

a first fluid supply portion configured to supply the first fluid to the first fluid supply path while the first fluid supply path is opened by the first opening/closing portion; and a second fluid supply portion configured to supply the second fluid to the second fluid supply path while the first fluid supply path is closed by the first opening/closing portion, wherein the second fluid supplied to the second fluid supply path by the second fluid supply portion while the first fluid supply path is closed off by the first opening/closing portion flows into the branch path after passing through the second fluid supply path, the discharge outlet, and the filter in this order.

2. The image-forming apparatus according to claim 1, further comprising:

a sucking portion configured to suck from an end side of the branch path opposite to the first fluid supply path, wherein in a state where the first fluid supply path is closed off by the first opening/closing portion, by suction of the sucking portion, the second fluid supplied to the second fluid supply path by the second fluid supply portion flows into the branch path after passing through the second fluid supply path, the discharge outlet, and the filter in this order.

3. The image-forming apparatus according to claim 1, wherein the branch path is communicated with the outside of the head, and the second fluid that has passed through the second fluid supply path, the discharge outlet, and the filter in this order while the first fluid supply path is closed off by the first opening/closing portion reaches the outside of the head via the branch path.

4. The image-forming apparatus according to claim 1, wherein the second fluid supply path is configured to be communicated with the discharge outlet, and the second fluid that has passed through the second fluid supply path flows into the inside of the head from the discharge outlet.

5. The image-forming apparatus according to claim 1, wherein the branch path is a path for exhausting gas present in the first fluid supply path when the first fluid is introduced into the first fluid supply path, and the first fluid and the second fluid are fluids having different compositions, further comprising:

a first fluid storage portion provided in the first fluid supply path, and which stores the first fluid;

a second fluid storage portion provided in the second fluid supply portion, and which stores the second fluid;

a branch path opening/closing portion opening and closing the branch path, downstream of a connecting portion where the branch path is connected to the first fluid supply path; and a control portion, wherein in a state in which the first fluid supply path is opened by the first opening/closing portion, the control portion controls the branch path opening/closing portion to a closed state such that the first fluid supplied to the first fluid supply path is supplied to the discharge outlet after passing through filter from the first fluid supply portion, and in a state in which the first fluid supply path is closed off by the first opening/closing portion, the control portion controls the branch path opening/closing portion to open the branch path such that the second fluid supplied to the second fluid supply path flows into the branch path after passing through the second fluid supply path, the discharge outlet, and the filter in this order.

6. The image-forming apparatus according to claim 5, further comprising:

a nozzle surface provided on the head and having the discharge outlet;

an exhaust port provided on the side of the branch path that is opposite the side communicated with the first fluid supply path;

a nozzle cap configured to contact the nozzle surface;

an exhaust cap configured to cover the exhaust port;

an inflow port provided in the nozzle cap and through which the second fluid flows in;

an outflow port provided in the nozzle cap and through which the second fluid flows out;

a waste fluid flow path connected to the outflow port;

a waste fluid flow path opening/closing portion configured to open and close the waste fluid flow path;

an exhaust cap exhaust port provided in the exhaust cap;

a pump provided downstream of the waste fluid flow path opening/closing portion;

an exhaust flow path connected to the exhaust cap exhaust port;

a second fluid supply path opening/closing portion configured to open and close the second fluid supply path;

a nozzle cap drive mechanism configured to move the nozzle cap up and down toward the nozzle surface; and an exhaust cap drive mechanism configured to move the exhaust cap up and down toward the nozzle surface;

wherein the branch path opening/closing portion opens and closes the exhaust flow path, one end portion of the second fluid supply path is connected to the inflow port, the second fluid supply path opening/closing portion is provided between the second fluid supply path and the second fluid storage portion, the downstream side of the branch path opening/closing portion is connected to the pump, and in a state in which the first fluid supply path is closed off by the first opening/closing portion, the control portion performs capping processing to cause the nozzle cap to come into contact with the nozzle surface by controlling the nozzle cap drive mechanism, and cover the exhaust port with the exhaust cap by controlling the exhaust cap drive mechanism, first valve opening processing to open the second fluid supply path opening/closing portion and the waste fluid flow path opening/closing portion, second fluid injecting processing to fill the nozzle cap with the second fluid by driving the pump, first valve closing processing to close the second fluid supply path opening/closing portion and the waste fluid flow path opening/closing portion, second valve opening processing to open the second fluid supply path opening/closing portion and the branch path opening/closing portion, and filter cleaning processing to cause the second fluid in the nozzle cap to flow through the discharge outlet and the filter in this order, and then flow into the branch path, by driving the pump.

7. The image-forming apparatus according to claim 6, wherein the control portion performs the capping processing, the first valve opening processing, the second fluid injecting processing, the first valve closing processing, the second valve opening processing, and the filter cleaning processing in this order.

8. The image-forming apparatus according to claim 6, wherein the control portion performs the capping processing, the first valve opening processing, the second fluid injecting processing, the first valve closing processing, the second valve opening processing, and the filter cleaning processing in this order, and the control portion causes the rotation speed of the pump during the second fluid injecting processing to be slower than the rotation speed when the first fluid is introduced into the first fluid supply path.

9. The image-forming apparatus according to claim 1, wherein the first fluid is ink, and the second fluid is cleaning fluid with respect to the first fluid.

10. The image-forming apparatus according to claim 1, further comprising:

a waste storage portion storing fluid from the branch path, wherein the head is provided in plurality, and the branch path is provided separately for each of the plurality of heads and the branch paths are communicated together before reaching the waste storage portion and then communicated with the waste storage portion.

11. A non-transitory computer-readable medium storing computer-readable instructions that, when executed by a processor of an image-forming apparatus including a first fluid supply path configured to supply a first fluid from one side of a discharge outlet of a head; a first opening/closing portion configured to open and close the first fluid supply path; a filter disposed in the first fluid supply path upstream of the discharge outlet of the head and downstream of the first opening/closing portion, and configured to filter the first fluid to be supplied to the discharge outlet of the head; a branch path communicated with the first fluid supply path upstream of the filter and downstream of the first opening/closing portion; a second fluid supply path configured to supply a second fluid from the other side that is the side opposite the one side of the discharge outlet; a first fluid supply portion configured to supply the first fluid to the first fluid supply path while the first fluid supply path is opened by the first opening/closing portion; a second fluid supply portion configured to supply the second fluid to the second fluid supply path while the first fluid supply path is closed by the first opening/closing portion; a branch path opening/closing portion configured to open and close the branch path downstream of a connecting portion where the branch path is connected to the first fluid supply path; a nozzle surface provided on the head and which has the discharge outlet; an exhaust port provided on the side of the branch path that is opposite the side communicated with the first fluid supply path; a nozzle cap configured to contact the nozzle surface; an exhaust cap configured to cover the exhaust port; an inflow port provided in the nozzle cap and through which the second fluid flows in; an outflow port provided in the nozzle cap and through which the second fluid flows out; a waste fluid flow path connected to the outflow port; a waste fluid flow path opening/closing portion configured to open and close the waste fluid flow path; an exhaust cap exhaust port provided in the exhaust cap; a pump provided downstream of the waste fluid flow path opening/closing portion; an exhaust flow path connected to the exhaust cap exhaust port; a second fluid supply path opening/closing portion configured to open and close the second fluid supply path; a nozzle cap drive mechanism configured to move the nozzle cap up and down toward the nozzle surface; an exhaust cap drive mechanism configured to move the exhaust cap up and down toward the nozzle surface; and a processor, in which the branch path opening/closing portion opens and closes the exhaust flow path, one end portion of the second fluid supply path is connected to the inflow port, the second fluid supply path opening/closing portion is provided between the second fluid supply path and a second fluid storage portion that stores the second fluid, and the downstream side of the branch path opening/closing portion is connected to the pump, cause the processor of the image-forming apparatus to execute the following processing including:

capping processing to cause the nozzle cap to come into contact with the nozzle surface by controlling the nozzle cap drive mechanism, and cover the exhaust port with the exhaust cap by controlling the exhaust cap drive mechanism, first valve opening processing to open the second fluid supply path opening/closing portion and the waste fluid flow path opening/closing portion, second fluid injecting processing to fill the nozzle cap with the second fluid by driving the pump, first valve closing processing to close the second fluid supply path opening/closing portion and the waste fluid flow path opening/closing portion, second valve opening processing to open the second fluid supply path opening/closing portion and the branch path opening/closing portion, and filter cleaning processing to cause the second fluid in the nozzle cap to flow through the discharge outlet and the filter in this order, and then flow into the branch path, by driving the pump.

12. A method for discharging deposits on a filter of an image-forming apparatus including a first fluid supply path configured to supply a first fluid from one side of a discharge outlet of a head; a first opening/closing portion configured to open and close the first fluid supply path; a filter disposed in the first fluid supply path upstream of the discharge outlet of the head and downstream of the first opening/closing portion, and configured to filter the first fluid to be supplied to the discharge outlet of the head; a branch path communicated with the first fluid supply path upstream of the filter and downstream of the first opening/closing portion; a second fluid supply path configured to supply a second fluid from the other side that is the side opposite the one side of the discharge outlet; a first fluid supply portion configured to supply the first fluid to the first fluid supply path while the first fluid supply path is opened by the first opening/closing portion; a second fluid supply portion configured to supply the second fluid to the second fluid supply path while the first fluid supply path is closed by the first opening/closing portion; a branch path opening/closing portion configured to open and close the branch path downstream of a connecting portion where the branch path is connected to the first fluid supply path; a nozzle surface provided on the head and which has the discharge outlet; an exhaust port provided on the side of the branch path that is opposite the side communicated with the first fluid supply path; a nozzle cap configured to contact the nozzle surface; an exhaust cap configured to cover the exhaust port; an inflow port provided in the nozzle cap and through which the second fluid flows in; an outflow port provided in the nozzle cap and through which the second fluid flows out; a waste fluid flow path connected to the outflow port; a waste fluid flow path opening/closing portion configured to open and close the waste fluid flow path; an exhaust cap exhaust port provided in the exhaust cap; a pump provided downstream of the waste fluid flow path opening/closing portion; an exhaust flow path connected to the exhaust cap exhaust port; a second fluid supply path opening/closing portion configured to open and close the second fluid supply path; a nozzle cap drive mechanism configured to move the nozzle cap up and down toward the nozzle surface; an exhaust cap drive mechanism configured to move the exhaust cap up and down toward the nozzle surface; and a processor, in which the branch path opening/closing portion opens and closes the exhaust flow path, one end portion of the second fluid supply path is connected to the inflow port, the second fluid supply path opening/closing portion is provided between the second fluid supply path and a second fluid storage portion that stores the second fluid, and the downstream side of the branch path opening/closing portion is connected to the pump, the method for discharging deposits on the filter of the image-forming apparatus comprising:

in a state in which the first fluid supply path is closed off by the first opening/closing portion, capping processing to cause the nozzle cap to come into contact with the nozzle surface by controlling the nozzle cap drive mechanism, and cover the exhaust port with the exhaust cap by controlling the exhaust cap drive mechanism;

first valve opening processing to open the second fluid supply path opening/closing portion and the waste fluid flow path opening/closing portion; second fluid injecting processing to fill the nozzle cap with the second fluid by driving the pump;

first valve closing processing to close the second fluid supply path opening/closing portion and the waste fluid flow path opening/closing portion;

second valve opening processing to open the second fluid supply path opening/closing portion and the branch path opening/closing portion; and filter cleaning processing to cause the second fluid in the nozzle cap to flow through the discharge outlet and the filter in this order, and then flow into the branch path, by driving the pump.

* * * * *